US007837136B2

(12) United States Patent
Yamada et al.

(10) Patent No.: US 7,837,136 B2
(45) Date of Patent: Nov. 23, 2010

(54) ELECTROSTATIC COATING DEVICE

(75) Inventors: Yukio Yamada, Fujieda (JP); Tatsunori Imanishi, Fujieda (JP)

(73) Assignee: ABB K.K., Tokyo (JP)

( * ) Notice: Subject to any disclaimer, the term of this patent is extended or adjusted under 35 U.S.C. 154(b) by 183 days.

(21) Appl. No.: 11/908,425

(22) PCT Filed: May 31, 2006

(86) PCT No.: PCT/JP2006/311356

§ 371 (c)(1),
(2), (4) Date: Sep. 12, 2007

(87) PCT Pub. No.: WO2007/015336

PCT Pub. Date: Feb. 8, 2007

(65) Prior Publication Data

US 2009/0026293 A1 Jan. 29, 2009

(30) Foreign Application Priority Data

Aug. 1, 2005 (JP) ..... 2005-223153

(51) Int. Cl.
*B05B 5/00* (2006.01)
*F23D 11/32* (2006.01)
*B05C 5/02* (2006.01)

(52) U.S. Cl. ..... 239/703; 239/690.1; 239/699; 239/700; 118/621; 118/623; 118/626

(58) Field of Classification Search ..... 239/690, 239/690.1, 699, 700, 703, 708; 118/50.1, 118/620, 621, 623, 626, 628, 639
See application file for complete search history.

(56) References Cited

U.S. PATENT DOCUMENTS

| | | | | |
|---|---|---|---|---|
| 4,659,012 | A * | 4/1987 | Coffee | 239/3 |
| 4,872,616 | A * | 10/1989 | Behr et al. | 239/703 |
| 5,011,086 | A * | 4/1991 | Sonnleitner et al. | 239/691 |
| 5,039,019 | A * | 8/1991 | Weinstein et al. | 239/691 |
| 5,085,373 | A * | 2/1992 | Behr et al. | 239/690 |
| 5,865,380 | A * | 2/1999 | Kazama et al. | 239/704 |
| 6,386,195 | B1 * | 5/2002 | Coffee | 128/200.14 |
| 6,708,908 | B2 * | 3/2004 | Heldt et al. | 239/700 |
| 6,896,735 | B2 * | 5/2005 | Giuliano et al. | 118/629 |

FOREIGN PATENT DOCUMENTS

| | | |
|---|---|---|
| JP | 38 7477 | 4/1963 |
| JP | 3 75856 | 7/1991 |
| JP | 10 57848 | 3/1998 |

OTHER PUBLICATIONS

U.S. Appl. No. 11/916,499, filed Dec. 4, 2007, Yamada.
U.S. Appl. No. 11/909,330, filed Sep. 21, 2007, Yamada.

* cited by examiner

*Primary Examiner*—Len Tran
*Assistant Examiner*—Ryan Reis
(74) *Attorney, Agent, or Firm*—Oblon, Spivak, McClelland, Maier & Neustadt, L.L.P.

(57) ABSTRACT

An atomizer including an air motor and a rotary atomizing head is mounted in a front side of a housing member, outer surfaces of which are covered in a cover member. Further, a high voltage discharge electrode assembly is provided around a front side of the housing member, with an outer periphery of the cover member circumvented by a blade ring of the high voltage discharge electrode assembly. An edge portion in the shape of a thin blade is provided at a projected rear end of the blade ring. Thus, an electric field is concentrated at the edge portion to induce a corona discharge on and around the entire blade ring.

10 Claims, 19 Drawing Sheets

ELECTROSTATIC COATING DEVICE

TECHNICAL FIELD

This invention relates to an electrostatic coating apparatus which is adapted to spray paint under application of a high voltage.

BACKGROUND ART

Generally, as an electrostatic coating apparatus, for example, there have been known paint coating apparatus which are constructed of an atomizer consisting of an air motor and a rotary atomizing head, a housing member adapted to hold the air motor of the atomizer, and a high voltage generator adapted to impart a negative high voltage electrostatic charge to sprayed paint particles (e.g., see, for example, Japanese Patent Laid-Open No. H10-57848 and Japanese Utility Model Laid-Open No. H3-75856).

In the case of prior art electrostatic coating apparatuses of the sort mentioned above, an electrostatic field is formed by lines of electric force between a rotary atomizing head which apply a negative high voltage electrostatic charge and a work piece. In this state, if the rotary atomizing head is put in high speed rotation to spray paint, sprayed paint particles which have been sprayed from a rotary atomizing head are electrostatically charged to become charged paint particles which are imparted with a negative high voltage electrostatic charge. Thus, charged paint particles are urged to fly toward and deposit on surfaces of a work piece which is connected to the earth.

Further, according to the prior art, repulsive electrodes are located on an outer peripheral side of a housing member, and a high voltage of the same polarity as charged paint particles is applied to the repulsive electrodes. By a repulsion force which occurs between a repulsive electrode and charged paint particles, the latter are urged to fly toward a work piece and prevented from depositing on the housing member.

In the case of electrostatic coating apparatuses disclosed in above-mentioned Japanese Patent Laid-Open No. H10-57848 and Japanese Utility Model Laid-Open No. H3-75856, a repulsive electrode which is located around the outer periphery of a housing member has a repulsion force effective against charged paint particles but not effective enough against electrostatically attenuated paint particles floating around a housing member and carrying only an attenuated quantity of electrostatic charge.

Further, in the case of electrostatic coating apparatus in Japanese Patent Laid-Open No. H10-57848 and Japanese Utility Model Laid-Open No. H3-75856, in order to prevent spark discharges between a repulsive electrode and a grounded body, the repulsive electrode is formed in the shape of a ring or ball with smooth surfaces to avoid concentration of electric field. Therefore, the repulsive electrode is incapable of supplying a sufficient quantity of discharge ions to outer surfaces of a housing member, resulting in failure in maintaining a high voltage electrostatic potential on outer surfaces of the housing member.

As a consequence, as an electrostatic coating operation is continued, paint particles start to gradually deposit on outer surfaces of the housing member and remain there as paint deposits. Such paint deposits give rise to a problem of degradations in insulation quality of outer surfaces of the housing member.

On the other hand, in order to maintain a housing member at a high voltage electrostatic potential, for example, there may be employed a repulsive electrode of a larger diameter to broaden high voltage discharge surface areas. However, in this case, there is a necessity for keeping the repulsive electrode at a sufficient distance from a work piece to prevent spark discharges which might occur between the repulsive electrode and a work piece or other grounded body since a high voltage is constantly applied to the repulsive electrode.

Therefore, in addition to degradations in performance quality, an operative range of an atomizer is narrowed by the use of a repulsive electrode of a large outside diameter. Especially, in a case where a coating operation is carried out in a narrow space like inside of vehicle body, difficulties are encountered in keeping a distance between a repulsive electrode and a grounded body like a vehicle body, and a coating operation becomes infeasible.

DISCLOSURE OF THE INVENTION

In view of the above-discussed problems with the prior art, it is an object of the present invention to provide an electrostatic coating apparatus with a high voltage discharge electrode which is reduced in size but has broadened high voltage discharge area.

(1) In order to solve the above-discussed problems, the present invention is applied to an electrostatic coating apparatus comprised of a paint atomizing means adapted to spray atomized paint particles toward a work piece, a housing member formed of an electrically insulating material to accommodate the paint atomizing means in position, a high voltage application means for imparting a high voltage electrostatic charge to paint particles sprayed by the paint atomizing means for electrostatic deposition on the work piece, and a corona ring formed in the shape of a ring circumventing the housing member and applied with a high voltage from the high voltage application means to induce corona discharges.

The electrostatic coating apparatus according to the present invention is characterized in that the corona ring comprises: a blade ring projected at least in axially forward, axially rearward, radially inward or radially outward of the housing member, the blade ring being gradually reduced in thickness toward a projected end in the fashion of a thin blade, providing a sharp edge portion all around the blade ring; the blade ring discharging a high voltage continuously substantially on and around entire edge portion.

As described above, as a corona ring, the electrostatic coating apparatus employs a blade ring with an edge portion which is projected toward a sharp edge in fashion of a thin blade. Therefore, electric field is concentrated at the edge portion, inducing corona discharge on and around entire blade ring, and a sufficient amount of discharge ions can be supplied to the housing member to maintain a high voltage electrostatic potential on outer surfaces of the housing member.

Further, the corona discharges at the edge portion of the blade ring contribute to recharge electrostatically attenuated paint particles. As a consequence, a repulsion force occurs between recharged paint particles and the blade ring or housing member, preventing deposition of paint particles on the housing member in an assured manner.

Furthermore, by the use of the edge portion of the blade ring, a corona discharge can be induced on and around the entire body of the annular blade ring which circumvents the housing member. Therefore, it becomes possible to downsize the blade ring as compared with a case where corona discharge is induced only part of a blade ring, permitting to secure a sufficient distance between the blade ring and a work piece to prevent spark discharges which would otherwise occur between the blade ring and a work piece, while broadening a range of movement of the atomizer even at the time of an operation in a narrow space to ensure higher performances.

(2) In this instance, according to the present invention, a number of notches may be provided at intervals along the edge portion of the blade ring.

With the arrangements just described, an electric field can be concentrated at opposite ends of the notches in the circumferential direction of the blade ring to let discharges take place more easily at opposite ends of the notches, thereby accelerating corona discharges by the blade ring.

(3) According to a feature of the present invention, the corona ring is constituted by a star ring formed in the shape of a star by bending a wire alternately in radially inward and outward directions toward and away from the housing member; the star ring discharging a high voltage continuously substantially on around entire parts thereof.

In case the corona ring is constituted by a star ring in the shape of a star which is formed by bending a wire at a plural number of points, further intensifying concentration of an electric field at bent portions of the ring. Accordingly, a discharge take place more easily at bent portions of the ring to accelerate corona discharges at the respective bent portions.

Furthermore, in case the wire diameter of the star ring is reduced, concentration of electric field on the entire star ring can be intensified and corona discharges can be induced continuously. Therefore, a sufficient amount of discharge ions can be supplied to the housing member to maintain a high voltage electrostatic potential on outer surfaces of the housing member.

Further, the corona discharges from the star ring contribute to recharge electrostatically attenuated paint particles. As a consequence, a repulsion force occurs between recharged paint particles and the star ring or housing member, preventing deposition of paint particles on the housing member in an assured manner.

Furthermore, as a corona discharge is induced on and around the entire star ring, it becomes possible to downsize the star ring as compared with a case where corona discharge is induced only part of a star ring, permitting to secure a sufficient distance between the star ring and a work piece to prevent spark discharges which would otherwise occur between the star ring and a work piece, while broadening a range of movement of the atomizer even at the time of an operation in a narrow space to ensure higher performances.

(4) According to another feature of the present invention, the corona ring is constituted by a helical ring formed by helically winding a wire into shape of a circular endless coil; the helical ring discharging a high voltage continuously substantially on and around entire parts thereof.

In this case, the corona ring is constituted by a helical ring which is helically wound into the shape of an endless circular coil. The helical ring can be downsized in outer configuration, and can be increased in total length of the wire. In case the wire diameter of the helical ring is reduced, concentration of electric field on the entire helical ring can be intensified and corona discharges can be induced continuously. Therefore, as corona discharge can be induced on the entire helical ring which is long size in total, a sufficient amount of discharge ions can be supplied to the housing member to maintain a high voltage electrostatic potential on outer surfaces of the housing member.

Further, the corona discharges from the helical ring contribute to recharge electrostatically attenuated paint particles. As a consequence, a repulsion force occurs between recharged paint particles and the helical ring or housing member, preventing deposition of paint particles on the housing member in an assured manner.

Furthermore, as a corona discharge is induced on and around the entire helical ring, it becomes possible to downsize the helical ring as compared with a case where corona discharge is induced only part of a helical ring, permitting to secure a sufficient distance between the helical ring and a work piece to prevent spark discharges which would otherwise occur between the helical ring and a work piece, while broadening a range of movement of the atomizer even at the time of an operation in a narrow space to ensure higher performances.

(5) In this instance, according to the present invention, the wire has a diameter between 0.3 mm and 5 mm.

Consequently, the electric field around the wire can be intensified to induce a corona discharge continuously on and around the entire corona ring, supplying a sufficient amount of discharge ions to the housing member while recharging electrostatically attenuated paint particles.

BEST MODE FOR CARRYING OUT THE INVENTION

Figure 1:
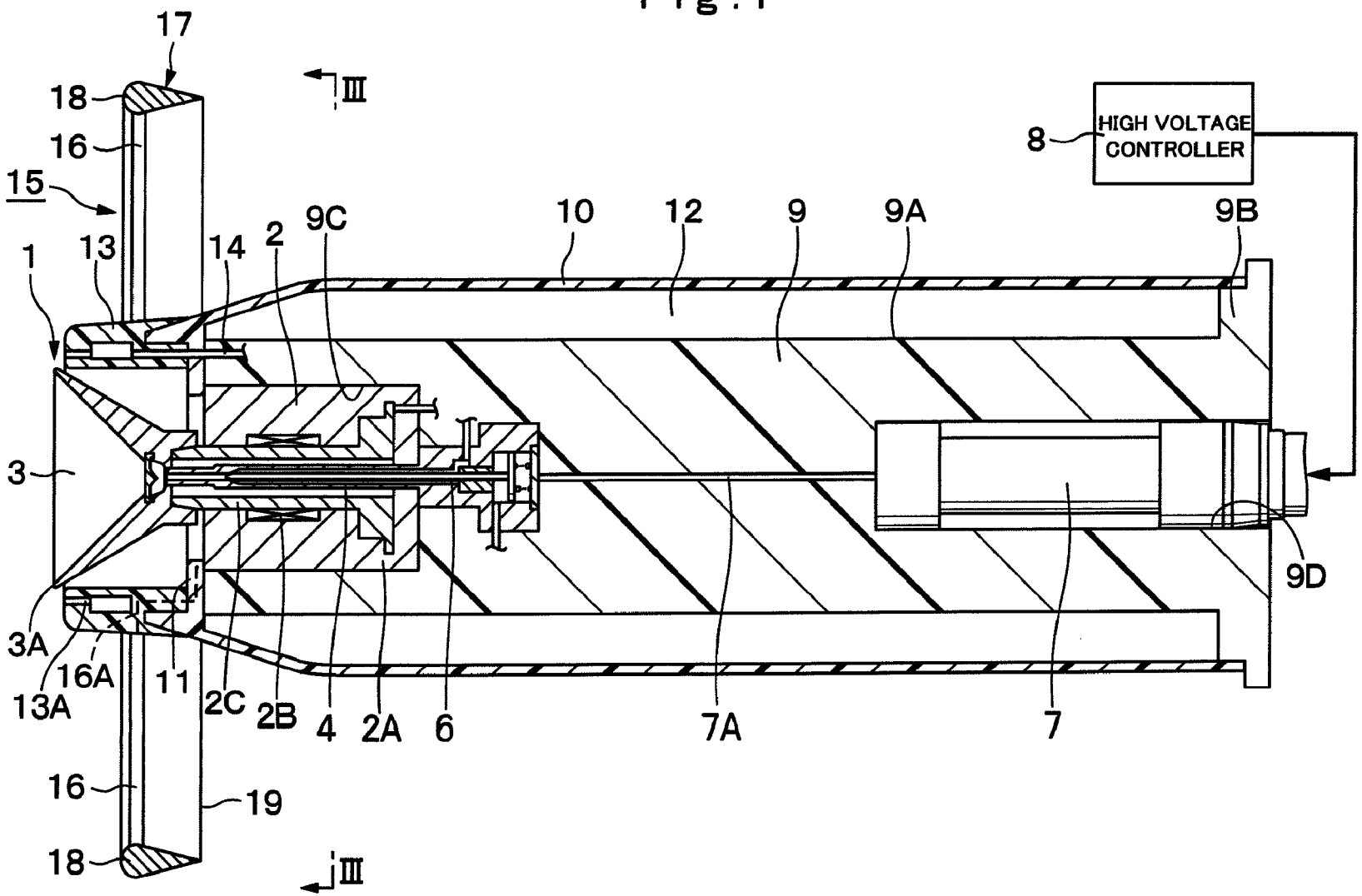
FIG. 1 is a longitudinal sectional view of a rotary atomizing head type coating apparatus according to a first embodiment of the present invention.
Figure 2:
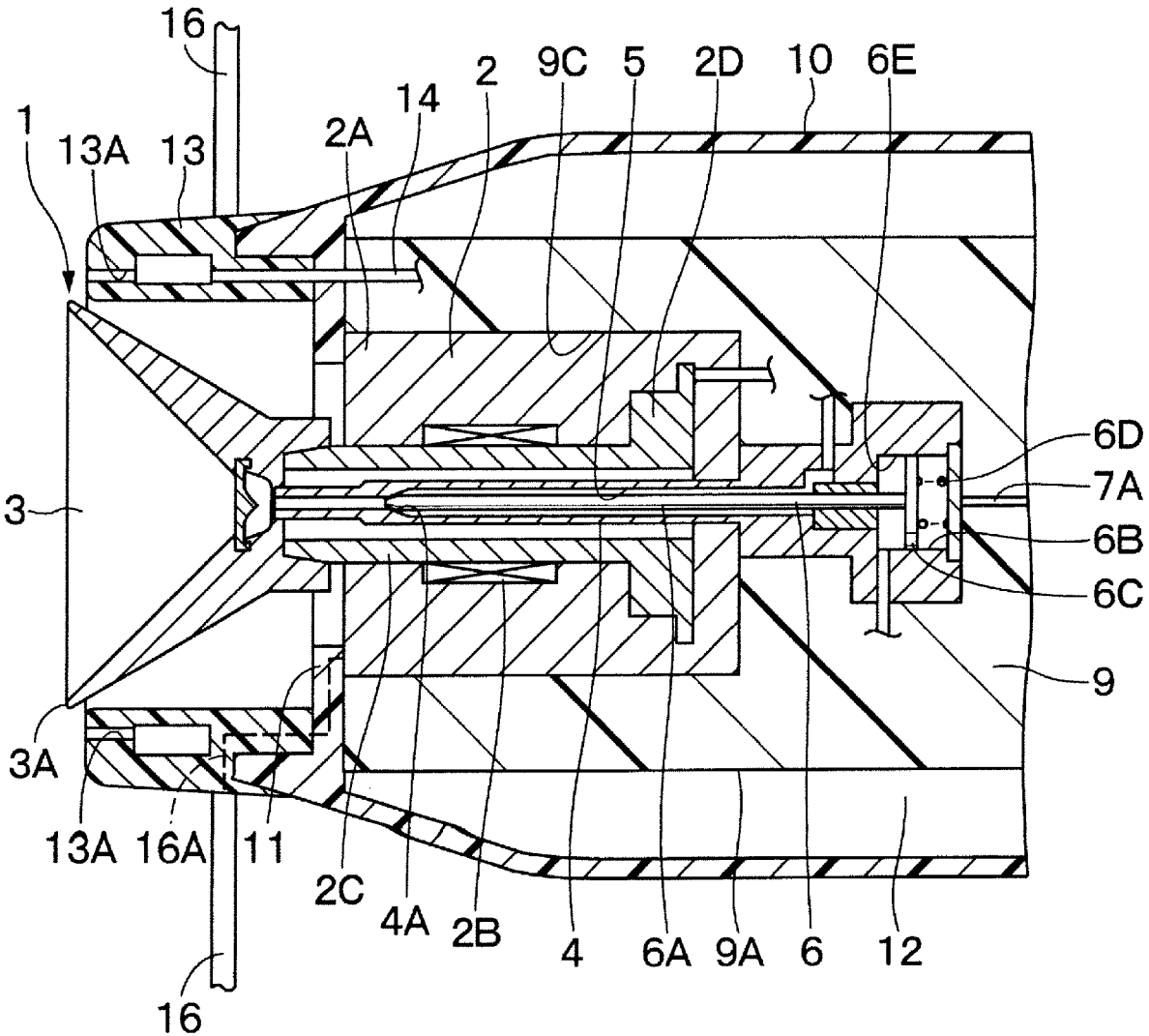
FIG. 2 is a fragmentary longitudinal section showing an atomizer of FIG. 1 and surrounding parts on an enlarged scale.
Figure 3:
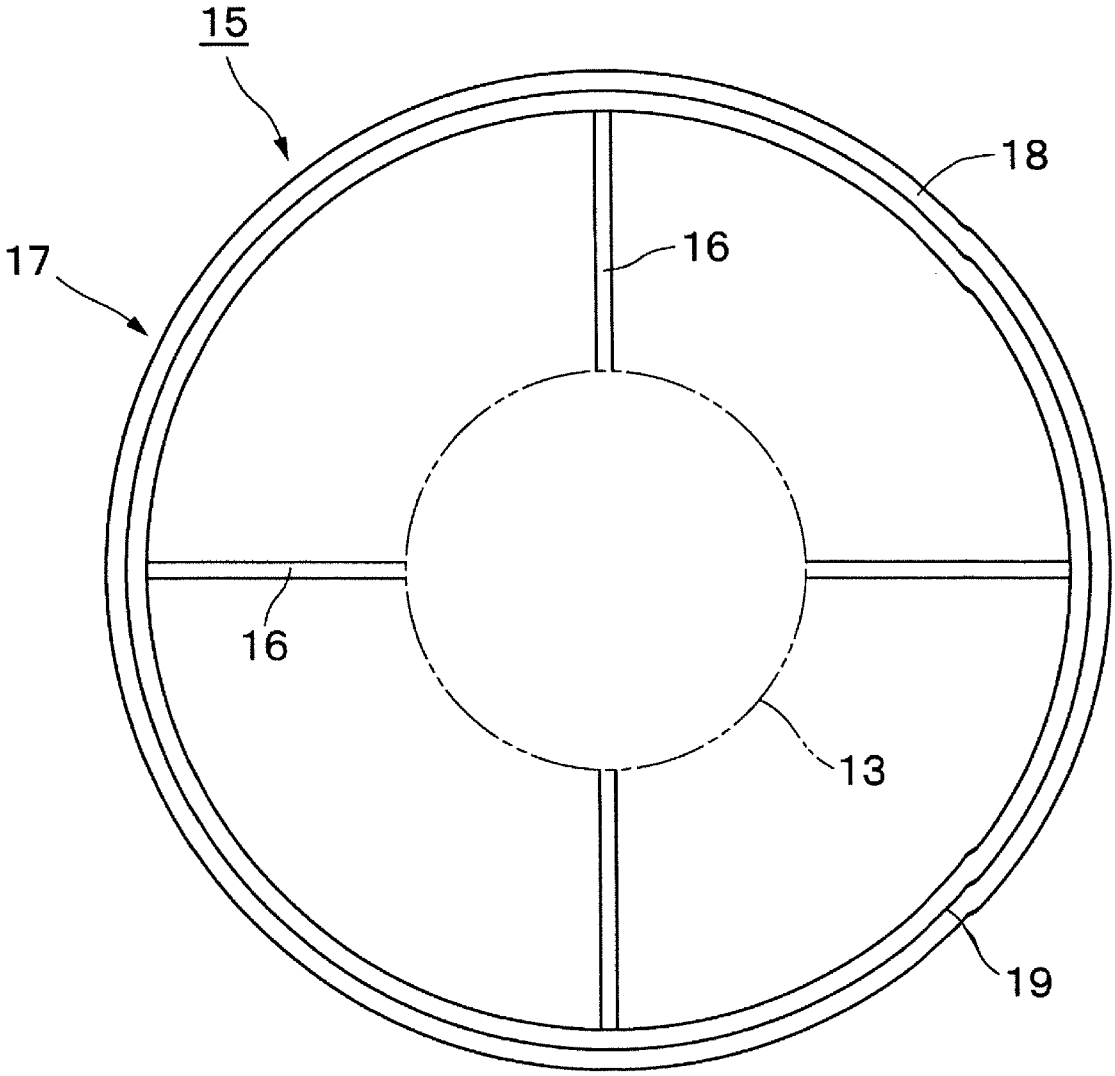
FIG. 3 is a right-hand side view of a high voltage discharge electrode assembly shown in FIG. 1, taken in the direction of arrows III-III of FIG. 1.
Figure 4:
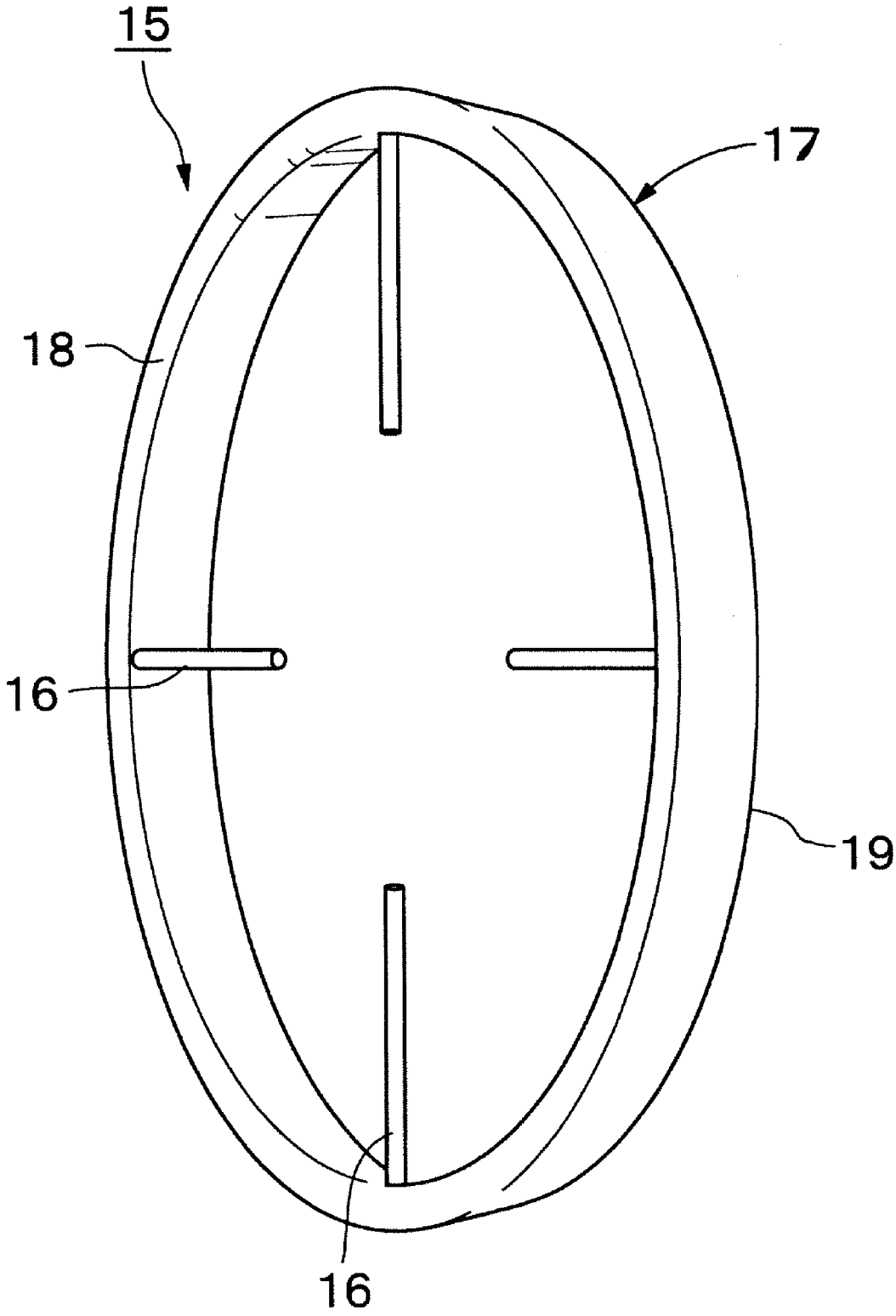
FIG. 4 is a perspective view of the high voltage discharge electrode assembly of FIG. 1 alone.
Figure 5:
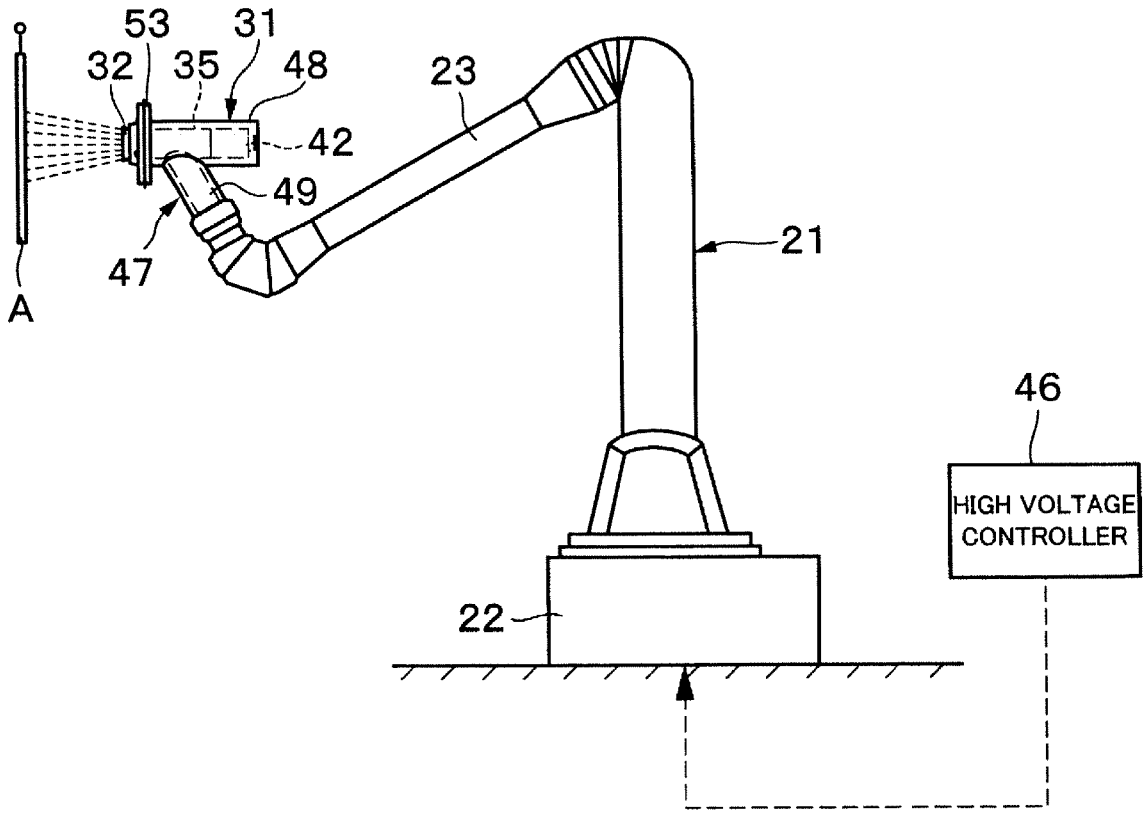
FIG. 5 is a front view of a rotary atomizing head type coating apparatus according to a second embodiment of the invention.
Figure 6:
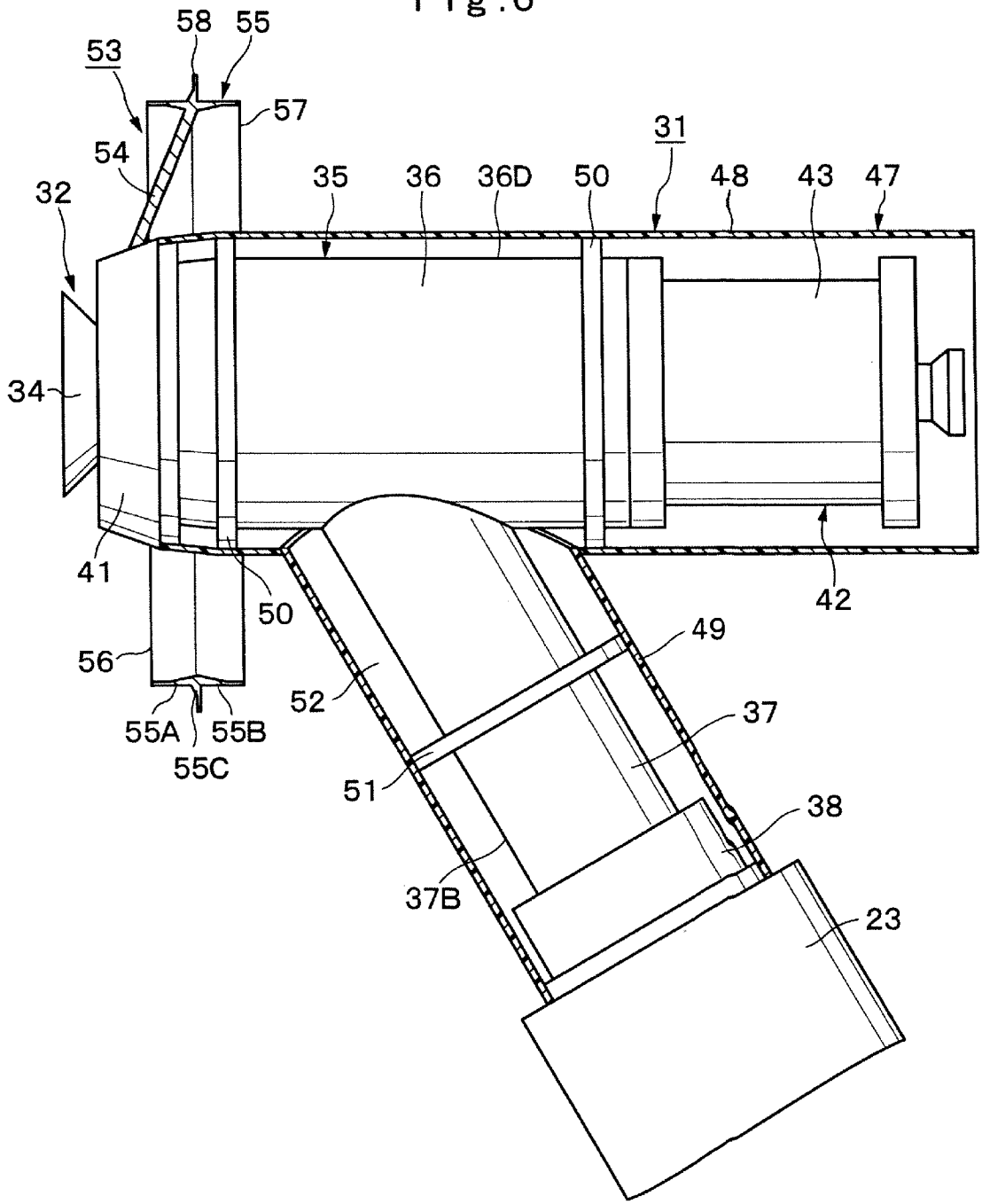
FIG. 6 is an enlarged front view of the coater unit of FIG. 5, with a cover member cut away to show inner components.
Figure 7:
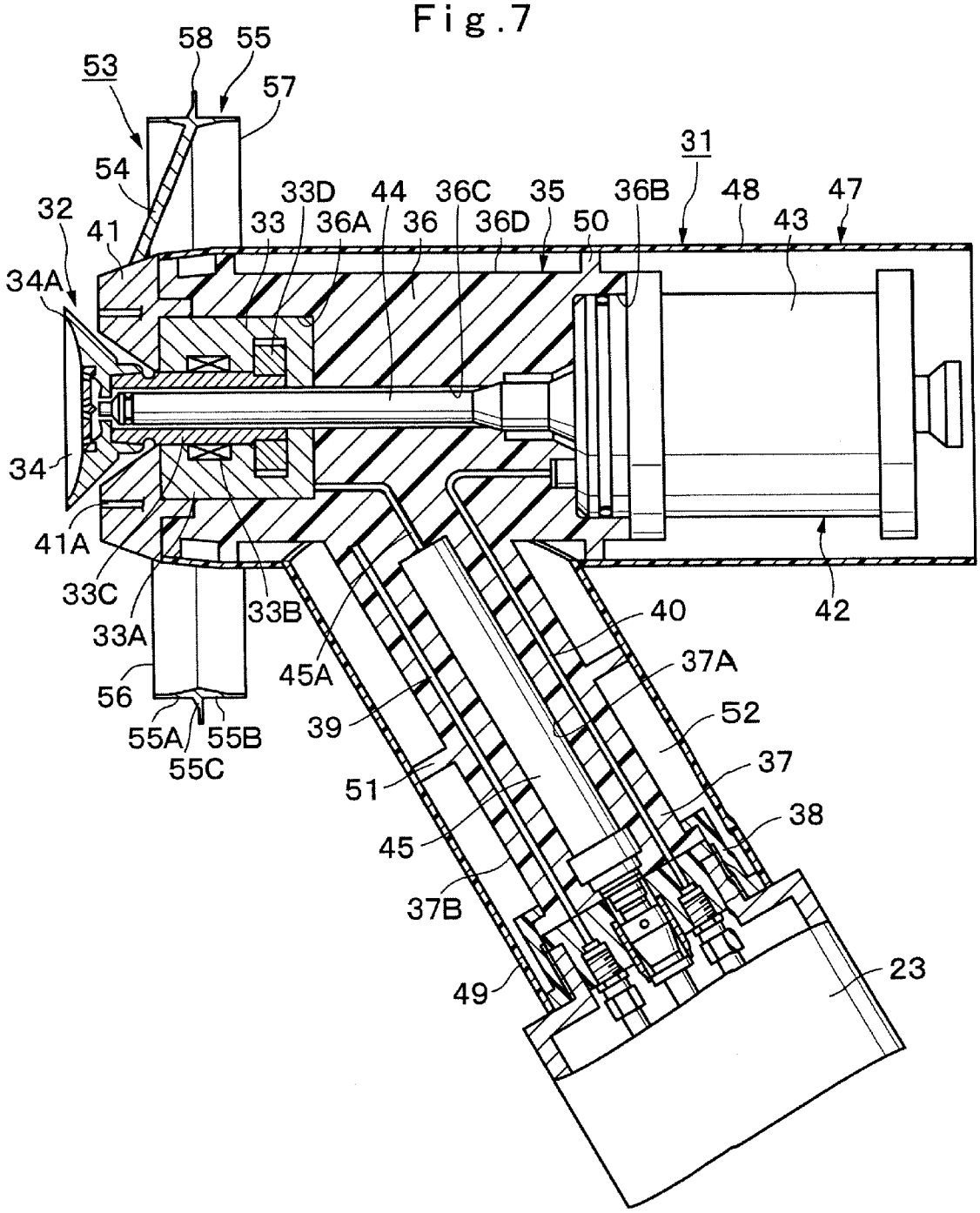
FIG. 7 is a longitudinal sectional view of the coater unit of FIG. 5.
Figure 8:
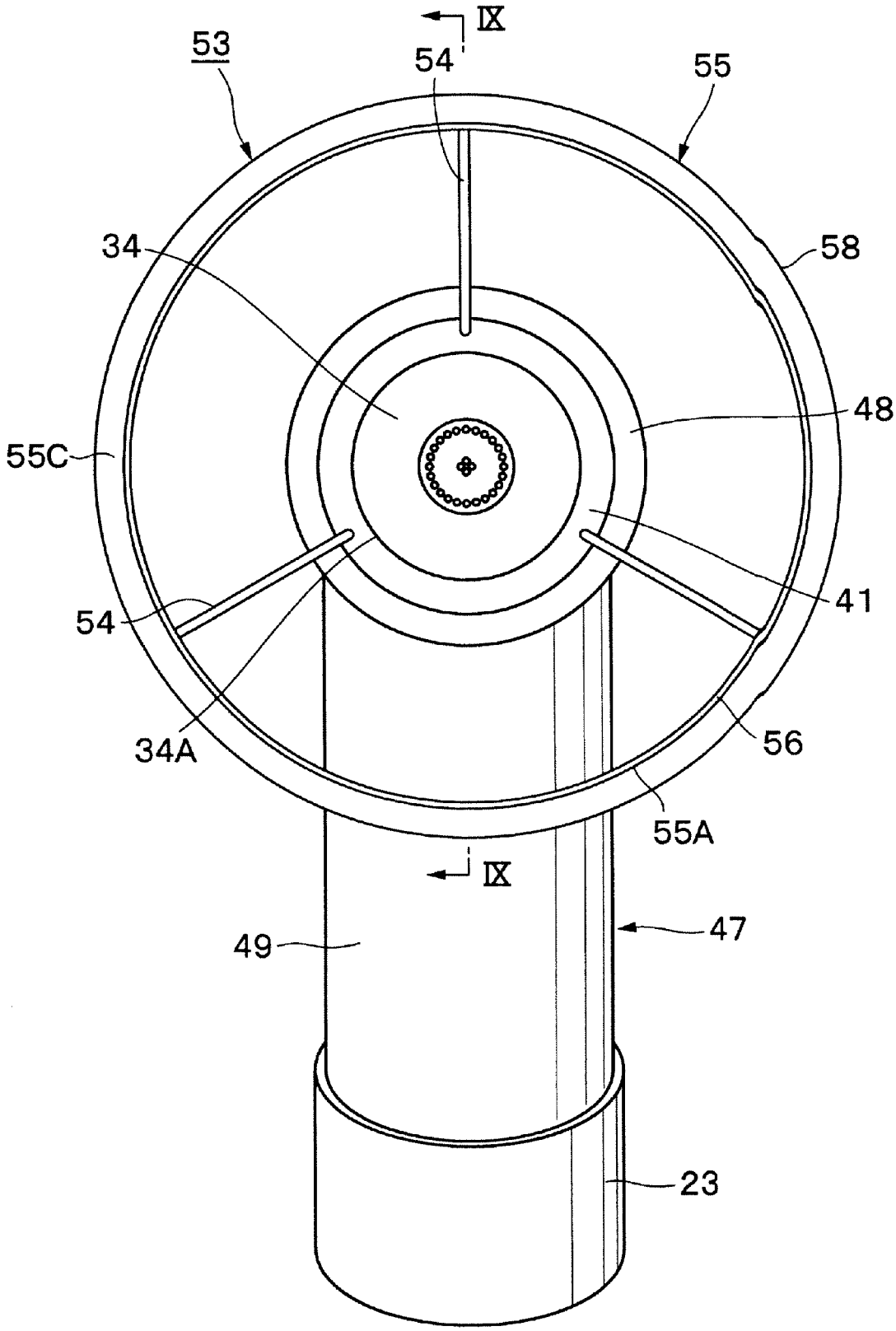
FIG. 8 is a left-hand side view of the coater unit of the second embodiment shown in FIG. 6.
Figure 9:
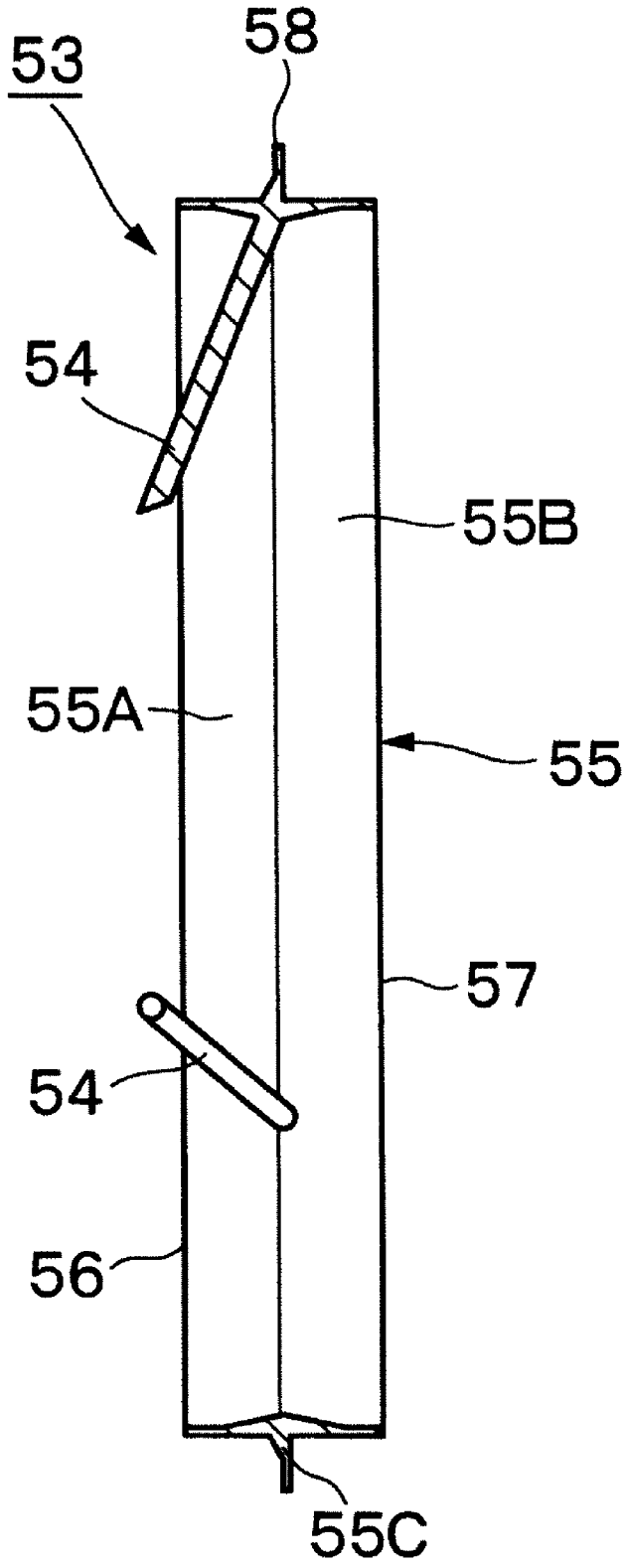
FIG. 9 is a cross-sectional view of a high voltage discharge electrode assembly alone, taken in the direction of arrows IX-IX of FIG. 8.
Figure 10:
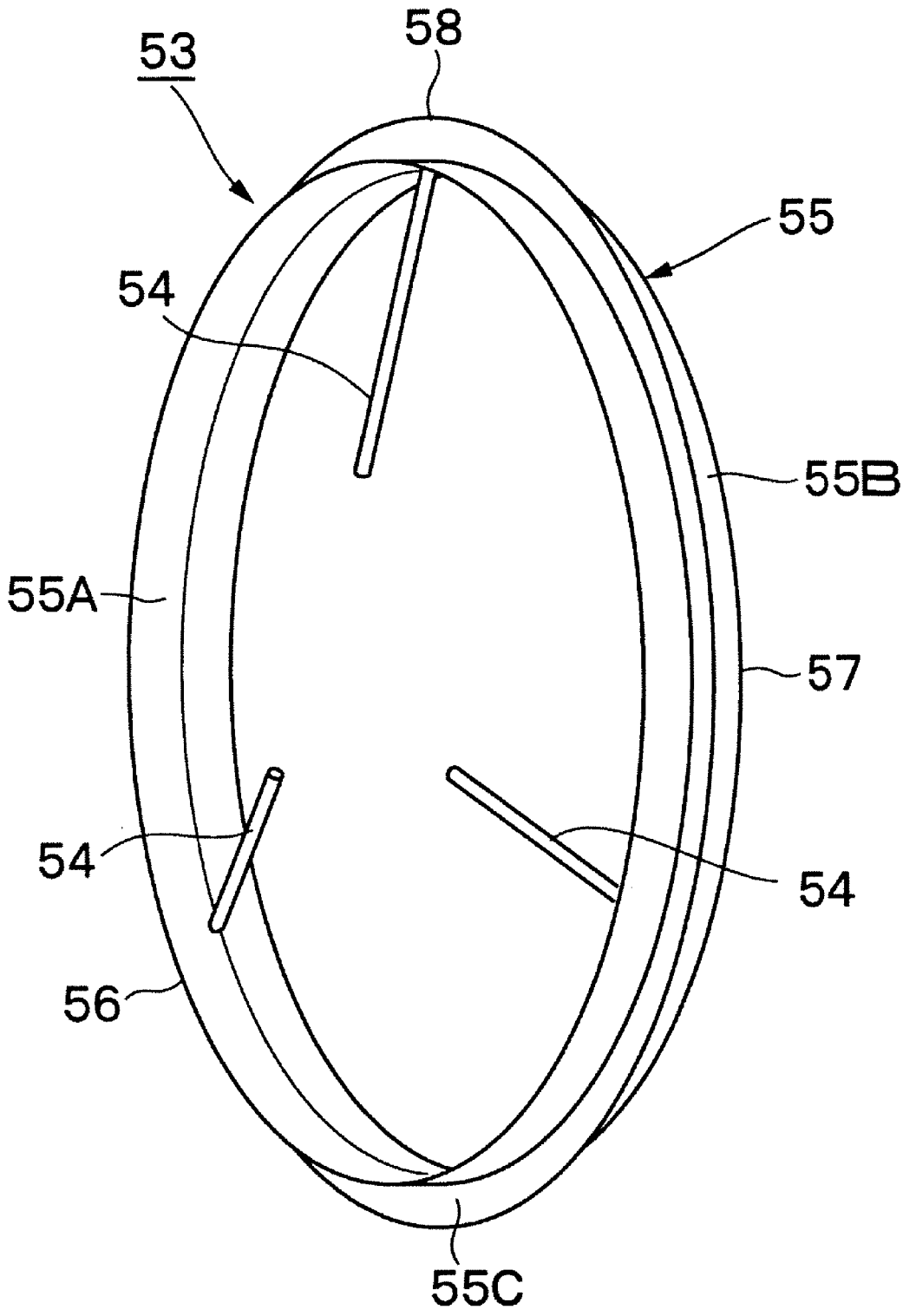
FIG. 10 is a perspective view of the high voltage discharge electrode assembly of FIG. 8.

Hereafter, with reference to the accompanying drawings, the present invention is described more particularly by way of its preferred embodiments which are applied by way of example to a rotary atomizing head type coating apparatus as an electrostatic coating apparatus.

Referring first to FIGS. 1 to 4, there is shown a first embodiment of the present invention. Referring to the drawings, indicated at 1 is an atomizer for spraying paint particles toward a work piece (not shown) which is held at the ground potential. This atomizer 1 is constituted by an air motor 2 and a rotary atomizing head 3, which will be described hereinafter.

Indicated at 2 is an air motor which is formed of a conducting metallic material. This air motor 2 is constituted by a motor housing 2A, a hollow rotational shaft 2C rotatably supported within the motor housing 2A through air bearing 2B, and an air turbine 2D which is fixedly provided on a base end portion of the rotational shaft 2C. Upon supplying drive air to the air turbine 2D, the rotational shaft 2C of the air motor 2 is put in high speed rotation, for example, rotated at a speed of 3,000 to 100,000 r.p.m. together with the rotary atomizing head 3.

Denoted at 3 is a rotary atomizing head which is mounted on a fore end portion of the rotational shaft 2C of the air motor 2. This rotary atomizing head 3 is formed of, for example, a conducting metallic material or a conducting synthetic resin material. After putting the rotary atomizing head 3 in high speed rotation by the air motor 2, paint is supplied thereto through a feed tube 4, which will be described hereinafter, whereupon supplied paint is sprayed from releasing edges 3A at the fore end of the rotary atomizing head 3 under the influence of centrifugal force. Further, the rotary atomizing head 3 is connected to a high voltage generator 7 through the air motor 2. Therefore, during an electrostatic coating operation, a high voltage is applied to the rotary atomizing head 3 as a whole, and a high voltage is directly charged to a paint flowing on surfaces of the rotary atomizing head 3.

Designated at 4 is a feed tube which is passed through the rotational shaft 2C. Fore end of the feed tube 4 is projected out of the fore end of the rotational shaft 2C and extended into the rotary atomizing head 3. A paint passage 5 which is provided internally of the feed tube 4 is connected to a paint supply source and a thinner supply source (both not shown) through a color changing valve device. A valve seat 4A is provided at a longitudinally intermediate portion of the feed tube 4 for seating and unseating a valve member 6A. Thus, the feed tube 4 is used to supply a paint from the paint supply source to the rotary atomizing head 3 through the paint passage 5 during a coating operation, and to supply a wash or cleaning fluid (thinner, air and so forth) from the thinner supply source at the time of a cleaning operation or at the time of color change.

In place of the feed tube 4 adopted in the present embodiment, there may be employed a feed tube of a double tube construction which has a paint passage internally of an inner tube and a thinner or cleaning fluid passage internally of an outer tube. Further, instead of providing the paint passage 5 internally of the feed tube 4 as in the present embodiment, there may be employed a paint passage of a different shape or of different routing depending upon the type of the atomizer 1.

Indicated at 6 is a paint supply valve, for example, a normally closed valve, which is provided within the length of the paint passage 5. This paint supply valve 6 is constituted by a valve body 6A which is extended internally of the paint passage 5 and provided with a fore end portion to be seated on and unseated from the valve seat 4A, a piston 6C which is provided at the base end of the valve body 6A and slidably fitted in a cylinder 6B, a valve spring 6D which is provided within the cylinder 6B to bias the valve body 6A in a closing direction, and a pressure receiving chamber 6E which is provided in the cylinder 6B on the opposite side of the piston 6C away from the valve spring 6D. As soon as drive air (a pilot air pressure) is introduced into the pressure receiving chamber 6E, the valve body 6A is moved in an opening direction against the action of the valve spring 6D to permit a paint flow through the paint passage 5.

Indicated at 7 is a high voltage generator which is connected to the air motor 2 to serve as a high voltage application means. This high voltage generator 7 is constituted by a multi-stage rectification circuit (the so-called Cockcroft circuit) which is constituted by a plurality of capacitors and diodes (both not shown). By the high voltage generator 7, a DC source voltage which is supplied from a high voltage controller 8 is elevated to generate a high voltage, for example, a high voltage in the range of −30 to −150 kV. At this time, output high voltage to be generated by the high voltage generator 7 is determined by the source voltage supplied from the high voltage controller 8. That is to say, the output voltage (a high voltage) of the high voltage generator 7 is controlled by the high voltage controller 8. Through a high voltage cable 7A, the high voltage generator 7 is connected to the air motor 2 and the rotary atomizing head 3 for directly charging paint with a high voltage by the rotary atomizing head 3.

Denoted at 9 is a housing member which is adapted to accommodate the air motor 2 and high voltage generator 7. This housing member 9 is formed substantially in a cylindrical shape by the use of an electrically insulating synthetic resin material, for example, such as POM (polyoxymethylene), PET (polyethylene terephthalate), PEN (polyethylene naphthalate), PP (polypropylene), HP-PE (high-pressure polyethylene), HP-PVC (high-pressure polyvinylchloride), PEI (polyether imide), PES (polyether sulfon), polymethyl pentene and the like.

The housing member 9 is provided with a cylindrical outer surface 9A on its outer peripheral side and a flanged large diameter rear end portion 9B at its rear end. A motor receptacle hole 9C is provided in a fore end portion of the housing member 9 to accommodate the air motor 2 therein, while a generator receptacle hole 9D provided in a rear end portion of the housing member 9 to accommodate the high voltage generator 7 therein.

Denoted at 10 is a cover member which is formed in a tubular shape to enshroud the housing member 9 in radially spaced relation with the outer surface 9A of the latter. This cover member 10 is formed of an electrically insulating and non-water-absorptive synthetic resin material with high insulating properties, for example, an electrically insulating synthetic resin material such as PTFE (polytetrafluoroethylene), POM (polyoxymethylene) or PET (polyethylene terephthalate) with surfaces treated with a water repellent agent and the like. Further, the cover member 10 is formed in a tubular shape and has a small wall thickness which is, for example, in the range of 0.1 mm to 5 mm for the sake of mechanical strength. Further, provided at the fore end of the cover member 10 is a front closing member 11 which is extended radially inward in such a way as to close the front end of the housing member 9.

In this instance, rear end of the cover member 10 is fixed on the flanged large diameter rear end portion 9B at the rear end of the housing member 9, while fore end of the cover member 10 is fixed around the front closing member 11. However, except the fixed fore and rear ends, substantially the entire inner peripheral surface of the cover member 10 is disposed to confront outer peripheral surface of the housing member 9 in a radially spaced relation with the latter. That is to say, a ring shaped annular gap space 12 in cross section exists between the cover member 10 and the housing member 9. This annular gap space 12 is formed around the entire outer peripheries of the air motor 2 and high voltage generator 7. In order to prevent leak current from the cover member 10 to the housing member 9, the annular gap space 12 is formed between the cover member 10 and the housing member 9, for example, in a width greater than 5 mm.

Indicated at 13 is a shaping air ring which spurts out shaping air. This shaping air ring 13 is attached to the front side (the fore side) of the cover member 10 through the front closing member 11 in such a way as to circumvent the outer periphery of the rotary atomizing head 3. Similarly to the cover member 10, the shaping air ring 13 is formed of a cylindrical shape by use of, for example, PTFE, POM or PET with surfaces treated with a water repellent agent. A multitude of air outlet holes 13A are bored in the shaping air ring 13, in communication with a shaping air passage 14 which is provided in the main housing member 9. Supplying shaping air through the shaping air passage 14, the air outlet holes 13A spurts out shaping air toward paint which are sprayed from the rotary atomizing head 3, for shaping the spray pattern of paint particles sprayed from the rotary atomizing head 3.

Denoted at 15 is a high voltage discharge electrode assembly which is located around the outer periphery of the shaping air ring 13. The high voltage discharge electrode assembly 15 is composed of support arms 16 and a blade ring 17, which will be described hereinafter.

Indicated at 16 are support arms which are extended radially outward from outer periphery of the shaping air ring 13. A plural number of support arms 16, for example, four support arms 16 are provided at uniform angular intervals around the shaping air ring 13 to support a blade ring 17 thereon. Further, the support arms 16 are formed of a conducting material and electrically connected to the air motor 2 through a connecting wire 16A.

Indicated at 17 is the blade ring which is supported on outer distal ends of the support arms 16. This blade ring 17 is formed substantially in a round tubular shape by the use of a conducting material like a metal, for example. Further, the blade ring 17 is constituted by a ring member 18 which is located on the front side, and a tapered edge portion 19 which is projected in a rearward direction from the ring member 18. The blade ring 17 is located around the air motor 2 in such a way as to circumvent the shaping air ring 13.

In this instance, generally the blade ring 17 is formed as a circular ring having an inside diameter, for example, approximately 150% to 250% larger than the outside diameter of the shaping air ring 13, and a length of 300 mm to 900 mm in the circumferential direction of the blade ring 17. Further, the blade ring 17 is located substantially in concentric relation with the rotational shaft 2C of the air motor 2. That is, at any angular position, the blade ring 17 is kept at the same distance from the outer periphery of the shaping air ring 13.

The blade ring 17 is connected to the air motor 2 through connecting wire 16A and support arms 16. Accordingly, by the high voltage generator 7, a high voltage is applied to the blade ring 17 including the edge portion 19.

Indicated at 18 is the ring member which is provided at the front side of the blade ring 17, and supported on outer distal ends of the support arms 16 in such a way as to circumvent the shaping air ring 13. The ring member 18 is rounded in a smooth arcuate shape face at its front end, on the other hand the ring portion is projected rearward in a thin blade-like shape at its rear end.

Designated at 19 is the edge portion which is projected rearward from the ring member 18 and tapered in the fashion of a thin blade, forming a sharp edge at the rear end of the blade ring 17. The edge portion 19 serves to enhance the electric field around the entire body of the blade ring 17. Therefore, for example, when a high voltage of 90 kV is applied, a discharge current of 20 μA to 100 μA flows through the edge portion 19, inducing corona discharge in a stable state.

Being arranged in the manner as described above, the rotary atomizing head type coating apparatus of the first embodiment gives the following performances in a coating operation.

As the rotary atomizing head 3 of the sprayer unit 1, is put in high speed rotation by the air motor 2, paint is supplied to the rotary atomizing head 3 through the feed tube 4. By the rotary atomizing head 3 of the sprayer unit 1 which is in high speed rotation, paint is atomized and sprayed in the form of finely divided particles under the influence of centrifugal force. At the same time, shaping air is supplied to the shaping air ring 13 thereby to control the spray pattern of paint particles.

Concurrently, a high voltage is applied to the rotary atomizing head 3 from the high voltage generator 7 through the air motor 2. Therefore, paint which has been supplied to the rotary atomizing head 3 is imparted with a high voltage electrostatic charge directly by the rotary atomizing head 3. Charged paint particles are urged to fly toward and deposit on a work piece, traveling along an electrostatic field which is formed between the rotary atomizing head 3 and the work piece.

Thus, according to the first embodiment, the high voltage discharge electrode assembly 15 is provided around the outer periphery of the shaping air ring 13, and a high voltage from the high voltage generator 7 is applied to the blade ring 17 through the air motor 2 and discharged from the edge portion 19.

Thus, a high voltage of the same polarity as charged paint particles is applied to the high voltage discharge electrode assembly 15, inducing corona discharges and thereby electrifying the cover member 10 with an electrostatic charge of the same polarity in a positive fashion. Further, by the high voltage discharge electrode assembly 15, an electrostatic field of a high voltage is formed around the outer peripheral side of the cover member 10. Therefore, by the electrostatic field of the high voltage discharge electrode assembly 15, electrified paint particles are kept off the cover member 10. Besides, the cover member 10 is imparted with a high voltage electrostatic charge to prevent deposition of paint particles.

On the other hand, by the corona discharge from the edge portion 19 which is extended rearward from entirely around the blade ring 17, the cover member 10 is imparted with a high voltage electrostatic charge up to its rear portions, and a high electrostatic potential can be maintained over broad areas of the cover member 10 to prevent deposition of charged paint particles.

Especially in the present embodiment, the blade ring 17 is tapered to the sharp edge portion 19 in the fashion of a thin blade. Therefore, an electrostatic field higher than a discharge initiating electrostatic field, for example, an electrostatic field of approximately 3 kV/m to 5 kV/m can be formed by the edge portion 19. Thus, the edge portion 19 makes it possible obtain a high electric field continuously, permitting to produce a large quantity of charges in a stabilized state.

Further, the edge portion 19 is formed entirely around the blade ring 17, so that it can induce corona discharge on the entire annular blade ring 17 which circumvents the housing member 9. Therefore, a sufficient amount of discharge ions is supplied to the cover member 10 on the exterior side of the housing member 9 to maintain the cover member 10 stably at a high voltage electrostatic potential.

Furthermore, by the corona discharges from the edge portion 19, electrostatically attenuated paint particles can be freshly imparted with an electrostatic charge. As repulsion forces can be generated between the freshly charged paint particles and the high voltage discharge electrode assembly 15 or cover member 10, deposition of paint particles on the cover member 10 can prevent in a more assured manner.

Moreover, by the use of the edge portion 19, corona discharges can be induced on the entire annular blade ring 17 which circumvents the cover member 10. Therefore, the blade ring 17 can be formed in a smaller size, for example, as compared with an electrode assembly having a number of acicular electrodes located at intervals around an annular ring member for corona discharges. Therefore, a sufficient distance can be kept between the high voltage discharge electrode assembly 15 and a work piece to prevent occurrence of spark discharges therebetween. It follows that, even at the time of a coating operation in a narrow space, the atomizer 1 can be moved in a broader range with higher maneuverability.

Further, according to the first embodiment, the cover member 10 is fitted around the outer periphery of the housing member 9 and spaced from the latter by the annular gap space 12. This arrangement reduces contact areas of the cover member 10 with the housing member 9 which is lower than air in electric resistance, preventing leaks of electrostatic charge on the exterior surfaces of the cover member 10 through the housing member 9 and keeping the cover member 10 in an electrostatically charged state to prevent deposition of charged paint particles.

Furthermore, according to the first embodiment, the shaping air ring 13 is described as being formed of an electrically insulating synthetic resin material. However, the present invention is not limited to a shaping air ring of this sort. For example, the shaping air ring may be formed of a conducting metallic material. In this case, a high voltage of the same potential as paint is applied to the shaping air ring through the air motor, letting same to act as a repulsive electrode to prevent deposition of charged paint particles on the shaping air ring.

Now, turning to FIGS. 5 through 10, there is shown a second embodiment of the present invention of the rotary atomizing head type coating apparatus. This second embodiment has features in that a housing member is composed of a main body portion which is extended in a longitudinal direction and adapted to hold a paint atomizing means, and a neck portion which is branched off the main body portion, while a cover member is composed of a body cover portion enshrouding the main body portion of the housing member, and a neck cover portion enshrouding the neck portion of the housing member.

In the drawings, indicated at 21 is a robot device which is adapted to carry out a coating operation automatically by the use of a coater unit which will be described later on. The robot device 21 is largely constituted by a base 22, and an articulated robot arm (an arm) 23 which is rotatably and pivotally supported on the base 22. The coater unit 31 is movable relative to a work piece A by the robot device 21, and connected to the earth ground.

Indicated at 31 is a cartridge type coater unit which is mounted on the robot device 21. The coater unit 31 is largely constituted by an atomizer 32, a housing member 35 and a paint cartridge 42, which will be described hereinafter.

Denoted at 32 is an atomizer which sprays atomized paint particles toward a work piece A which is held at the earth potential. The atomizer 32 is constituted by an air motor 33 and a rotary atomizing head 34 and the like which will be described hereinafter.

Indicated at 33 is an air motor which is formed of a conducting metallic material. This air motor 33 is constituted by a motor housing 33A, a rotational shaft 33C which is rotatably supported within the motor housing 33A through a static air bearing 33B, and an air turbine 33D which is fixedly mounted on a base end portion of the rotational shaft 33C. Upon supplying drive air to the air turbine 33D through an air passage 39 which will be described hereinafter, the rotational shaft 33C of the air motor 33 is put in high speed rotation, for example, rotated at a speed of 3,000 to 100,000 r.p.m together with the rotary atomizing head 34.

Indicated at 34 is a rotary atomizing head which is mounted on a fore end portion of the rotational shaft 33C of the air motor 33. This rotary atomizing head 34 is formed of, for example, a conducting metallic material or conducting synthetic resin material. Through a feed tube 44 which will be described hereinafter, paint is supplied to the rotary atomizing head 34 which is put in high speed rotation by the air motor, and atomized paint particles are sprayed forward from a paint releasing edges 34A at the fore end of the rotary atomizing head 34 under the influence of centrifugal force. Further, the rotary atomizing head 34 is connected to a high voltage generator 45 through the air motor 33, which will be described after. Therefore, during an electrostatic coating operation, a high voltage is applied to the rotary atomizing head 34 as a whole to apply a high voltage electrostatic charge directly to paint which is flowing on surfaces of the rotary atomizing head 34.

Indicated at 35 is a housing member which holds the air motor 33 in position. Similarly to the housing member 9 in the foregoing first embodiment, this housing member 35 is formed of an electrically insulating synthetic resin material, for example, such as POM (polyoxymethylene), PET (polyethylene terephthalate), PEN (polyethylene naphthalate), PP (polypropylene), HP-PE (high-pressure polyethylene), HP-PVC (high-pressure polyvinylchloride), PEI (polyether imide), PES (polyether sulfon), polymethyl pentene and the like.

The housing member 35 is composed of a longitudinally extending cylindrical main body portion 36, and a neck portion 37 which is branched off from an axially intermediate portion of the main body portion 36 and extended obliquely in a rearward direction.

Formed into the fore end of the main body portion 36 is a motor receptacle hole 36A which is adapted to accommodate the air motor 33, while formed into the rear end of the main body portion 36 is a container receptacle hole 36B which is adapted to accommodate a container 43 of a paint cartridge 42, which will be described hereinafter. Further, a feed tube passage hole 36C is formed axially in the main body portion 36 through centers of the motor receptacle hole 36A and container receptacle hole 36B.

On the other hand, a generator receptacle hole 37A is provided in the neck portion 37 to accommodate a high voltage generator 45 which will be described later on. Base end of the neck portion 37 is attached to the fore end of the robot arm 23 of the robot device 21 through a tubular connector member 38 which is formed of an electrically insulating synthetic resin material. Further, an air passage 39 is formed internally of the housing member 35 to supply drive air to the air motor 33, along with an extruding liquid passage 40 which supplies an extruding liquid to a paint cartridge 42 for controlling a flow rate of paint as described in greater detail hereinafter.

Denoted at 41 is a shaping air ring which is provided on the front side of the main body portion 36 of the housing member 35 in such a way as to circumvent the rotary atomizing head 34. This shaping air ring 41 is formed, for example, by the use of a conducting metallic material, and electrically connected to the air motor 33. A plural number of air outlet holes 41A bore in the shaping air ring 41 to spurt out shaping air toward paint particles sprayed from the rotary atomizing head 34.

Indicated at 42 is a paint cartridge which supplies paint to the rotary atomizing head 34. This paint cartridge 42 is largely constituted by a container 43 in the form of an axially extending tubular (cylindrical) casing, a feed tube 44 which is extended axially forward from the container 43, and a piston which defines a paint chamber and an extruding liquid chamber (both not shown) within the casing of the container 43.

The paint cartridge 42 is set in a container receptacle hole 36B at the rear end of the housing member 35, after inserting the feed tube 44 in the feed tube passage hole 36C. At the time of a coating operation, an extruding liquid is supplied to the extruding liquid chamber through the extruding liquid passage 40 in the housing member 35, displacing the piston forward and thereby forcing paint to flow into the feed tube 44 from the container 43 for supply to the rotary atomizing head 34. At the time of refilling the paint cartridge 42, it is detached from the container receptacle hole 36B and connected to a paint replenisher (not shown) to refill paint into the paint chamber in the container 43 through the feed tube 44.

Indicated at 45 is a high voltage generator which is accommodated in the neck portion 37 of the housing member 35 as a high voltage application means. Input side of this high voltage generator 45 is connected to an external high voltage controller 46 through the robot device 21, and its output side is connected to the air motor 33. For example, the high voltage generator 45 is a multi-stage rectification circuit (i.e., so-called Cockcroft circuit) which is constituted by a plurality of capacitors and diodes.

The high voltage generator 45 generates, for example, a high voltage of −30 kV to 150 kV by elevating a DC source voltage which supplied from the high voltage controller 46. The output level (the high voltage output) of the high voltage generator 45 is determined depending upon the level of the source voltage which is supplied from the high voltage controller 46, that is to say, controlled by the level of the source voltage from the high voltage controller 46. By the high voltage generator 45, paint is directly imparted with a high voltage electrostatic charge by way of the air motor 33 and rotary atomizing head 34 through high voltage cable 45A.

Indicated at 47 is a cover member enshrouding outer surfaces of the housing member 35. This cover member 47 is formed by the use of a fluorine-base synthetic resin material which is high in resistance and non-water-absorptive, for example, by the use of a film or sheet of fluorine-base synthetic resin material such as PTFE (polytetrafluoroethylene) and ETFE (a copolymer of ethylene and tetrafluoroethylene). Further, the cover member 47 is composed of a body cover 48 enshrouding the outer surface 36D of the main body portion 36, and a neck cover 49 enshrouding the outer surface 37B of the neck portion 37. The respective covers 48 and 49 are each formed, for example, by rolling a synthetic resin film having a thickness of 0.1 mm to 5 mm into a tubular shape.

In this instance, the body cover 48 is extended rearward of the main body portion 36, covering not only the outer surface 36D of the main body portion 36 but also the outer surfaces of the container 43 of the paint cartridge 42. The body cover 48 is fitted on annular flanges 50 which are provided in opposite front and rear end portions of the main body 36. On the other hand, the neck cover 49 is fitted on an annular flange 51, which is provided at a longitudinally intermediate position on the neck portion 37, and on the connector member 38 which is provided at a lower distal end of the neck portion 37.

Except small surface areas which are in contact with the flanges 50, almost the entire inner surface of the body cover 48 which confronts face to face with the outer surface 36D of the main body portion 36 is spaced away from and kept out of contact with the latter. Similarly, except small surface areas which are in contact with the flange 51 and connector member 38, almost the entire inner surface of the neck cover 49 which confronts face to face with the outer surface 37B of the neck portion 37 is spaced away from and kept out of contact with the latter.

As a consequence, the main body portion 36 and the body cover 48 are intervened by an annular gap space 52 of an annular shape in cross section, and similarly the neck portion 37 and neck cover 49 are intervened by an annular gap space 52 of an annular shape in cross section. Thus, the cover member 47 and housing member 35 are intervened by an annular gap space 52 almost in entire areas. Consequently, on the outer peripheral side, the air motor 33 and high voltage generator 45 are surrounded by the annular gap space 52 substantially in entire areas. The annular gap spaces 52 are formed between the cover member 47 and housing member 35, for example, in a width of 5 mm or more in order to prevent leak current from the cover member 47 to the housing member 35.

Designated at 53 is a high voltage discharge electrode assembly which is located around the outer periphery of the shaping air ring 41. This high voltage discharge electrode assembly 53 is composed of support arms 54, blade ring 55 and edge portions 56, 57 and 58, which will be described hereinafter.

Indicated at 54 are support arms which are extended radially outward from the outer periphery of the shaping air ring 41. More specifically, the support arms 54 are extended radially outward from the side of the housing member 35 as far as a position on the outer peripheral side (radially outward) of the body cover 48. For example, three support arms 54 are provided at uniform angular intervals around the shaping air ring 41 to support the blade ring 55 thereon.

Indicated at 55 is a blade ring which is supported on outer distal ends of the support arms 54. This blade ring 55 is formed substantially in a tubular shape, for example, by the use of conducting material like a metal. Further, the blade ring 55 is provided with fore and rear blade portions 55A and 55B which are projected in forward and rearward directions, respectively, and an annular outer flange portion 55C which is projected in a radially outward direction. Moreover, the blade ring 55 is located around the air motor 33 in such a way as to circumvent a front portion of the body cover 48.

In this instance, the blade ring 55 is in the form of a circular ring having an outside diameter which is, for example, 150% to 200% larger than outside diameter of the body cover 48, and having a length of approximately 300 mm to 900 mm in the circumferential direction. Further, the blade ring 55 is positioned substantially in concentric relation with the rotational shaft 33C of the air motor 33. Thus, the blade ring 55 is kept at a constant distance from the body cover 48 at any angular position around its body.

Further, the blade ring 55 is connected to the air motor 33 through the support arms 54 and shaping air ring 41. Therefore, a high voltage is applied to the blade ring 55 from the high voltage generator 45.

Indicated at 56, 57 and 58 are edge portions which are provided at outer distal ends of the fore and rear blade portions 55A and 55B and the flange portion 55C, respectively. In this instance, the front edge portion 56 is formed by gradually reducing the thickness of the fore blade portion 55A in the forward direction in the fashion of a thin blade. Similarly, the back edge portion 57 is formed by gradually reducing the thickness of the rear blade portion 55B in the rearward direction in the fashion of a thin blade. Further, the top edge portion 58 is formed by gradually reducing the thickness of the outer flange portion 55C in a radially outward direction.

The front, back and top edge portions 56, 57 and 58 serve to intensify the electric field all around the blade ring 55. For example, when a high voltage of 90 kV is applied to the edge portions 56 to 58, a discharge current of 20 μA to 100 μA flows through the edge portions 56 to 58, inducing corona discharge in a stabilized state.

Being arranged in the manner as described above, the rotary atomizing head type coating apparatus of the second embodiment gives the following performances as a coating apparatus.

As a work piece A is located in the vicinity of the robot device 21 by a conveyer, or the like, the robot device 21 is put in a playback action according to pre-loaded teaching actions in a memory, bringing the coater unit 31 to an operative position relative to the work piece A.

At this time, the rotary atomizing head 34 on the coater unit 31 is put in high speed rotation by the air motor 33, and paint is supplied to the rotary atomizing head 34 from the container 43 through the feed tube 44. Under the influence of centrifugal force resulting from high speed rotation of the rotary atomizing head 34, paint is sprayed forward in the form of finely divided particles by the coater unit 31. Concurrently, shaping air is spurted out from the shaping air ring 41 to control the spray pattern of paint particles.

At the same time, a high voltage is applied to the rotary atomizing head 34 from the high voltage generator 45 through the air motor 33. Accordingly, the paint which has been supplied to the rotary atomizing head 34 is directly charged with a high voltage by the rotary atomizing head 34 and sprayed in the form of charged paint particles. The charged paint particles are urged to fly toward and deposit on a work piece A which is held at the earth potential, traveling along an electrostatic field which is formed between the rotary atomizing head 34 and the work piece A.

Thus, according to the second embodiment, the high voltage discharge electrode assembly 53 is provided around the outer periphery of the body cover 48, applying a high voltage to the blade ring 55 from the high voltage generator 45 through the air motor 33 and shaping air ring 41 and letting the blade ring 55 discharge the high voltage from the front and back edge portions 56 and 57 and the top edge portion 58 as well. Thus, ions of the same polarity as the charged paint particles are discharged by the use of the high voltage discharge electrode assembly 53, while imparting an electrostatic charge of the same polarity to the cover member 47.

In addition, a high voltage electrostatic field can be formed around the outer periphery of the cover member 47 by the blade ring 55. Thus, the electrostatic field of the blade ring 55 contributes to keep charged paint particles off the cover member 47, imparting a high voltage electrostatic charge to the cover member 47 to prevent deposition of charged paint particles.

Furthermore, since the blade ring 55 is arranged to circumvent the body cover 48, as compared with the case of excluding the high voltage discharge electrode assembly 53, it can impart a high voltage electrostatic charge to broader areas of the cover member 47 from entire part of blade ring 55, thus preventing deposition of charged paint particles in broader areas at the cover member 47.

In this connection, if a discharge ring without an edge were used, the strongest discharge would occur at a point which is closest to a grounded body. In such a case, it is very likely that only weak discharges take place at other points under the influence of electron clouds resulting from the strong discharge.

In contrast, according to the second embodiment of the invention, the blade ring 55 is provided with edge portions 56 to 58 each in the shape of a sharp blade edge. Therefore, an extremely strong electric field which is higher than a discharge initiating electric field, for example, an electric field of 3 kV/m to 5 kV/m can be secured at the respective edge portions 56 to 58, thereby suppressing strong discharges which might occur to part of the blade ring 55 on approach to a coating object (a grounded object) and inducing stabilized discharge all around the blade ring 55 by way of the edge portions 56 to 58.

Further, since the edge portions 56 to 58 are formed all around the blade ring 55, corona discharges take place on the entire annular body of the blade ring 55 which circumvents the cover member 47. Accordingly, a sufficient amount of discharge ions can be supplied to the cover member 47 for maintaining same at a high electrostatic potential in a stabilized state.

Besides, the corona discharges at the edge portions 56 to 58 play the role of recharging paint particles with an attenuated amount of electrostatic charge. Consequently, a repulsion force occurs between recharged paint particles and the blade ring 55 or the cover member 47 to prevent deposition of paint particles on the cover member 47 in a more assured manner.

Furthermore, since corona discharges can be induced by the edge portions 56 to 58 on and around the entire annular body of the blade ring 55 which circumvents the cover member 47, it is possible to downsize the blade ring 55 as compared with a blade ring which is arranged to induce corona discharges at part of its annular body. As a result, it becomes possible to keep the blade ring 55 at a sufficient distance from a work piece A to prevent corona discharges between them. Accordingly, even in a coating operation in a narrow space, the atomizer 32 can be moved in a broader range with higher maneuverability.

In addition to the fore and rear blade portions 55A and 55B, the blade ring 55 is provided with the outer flange portion 55C which is extended radially outward, and edge portions 56 to 58 in the shape of a thin blade edge are formed on these fore and rear blade portions 55A and 55B and the outer flange portion 55C. Therefore, electric field can be concentrated not only at the edge portions 56 and 57 on the fore and rear blade portions 55A and 55B but also at the edge portion 58 on the outer flange portion 55C induce corona discharge. Therefore, a sufficient amount of discharge ions can be supplied to the cover member 47, while accelerating recharging of paint particles.

Furthermore, according to the second embodiment, the housing member 35 is enshrouded by the cover member 47, and the annular gap space 52 is provided between the housing member 35 and the cover member 47. Therefore, by the provision of the annular gap space 52, contacting areas of the housing member 35 with the cover member 47 can be reduced to suppress leaks of electrostatic charge on the exterior surface of the cover member 47 through the housing member 35, maintaining the cover member 47 in an electrostatically charged state to prevent deposition of paint particles.

Figure 11:
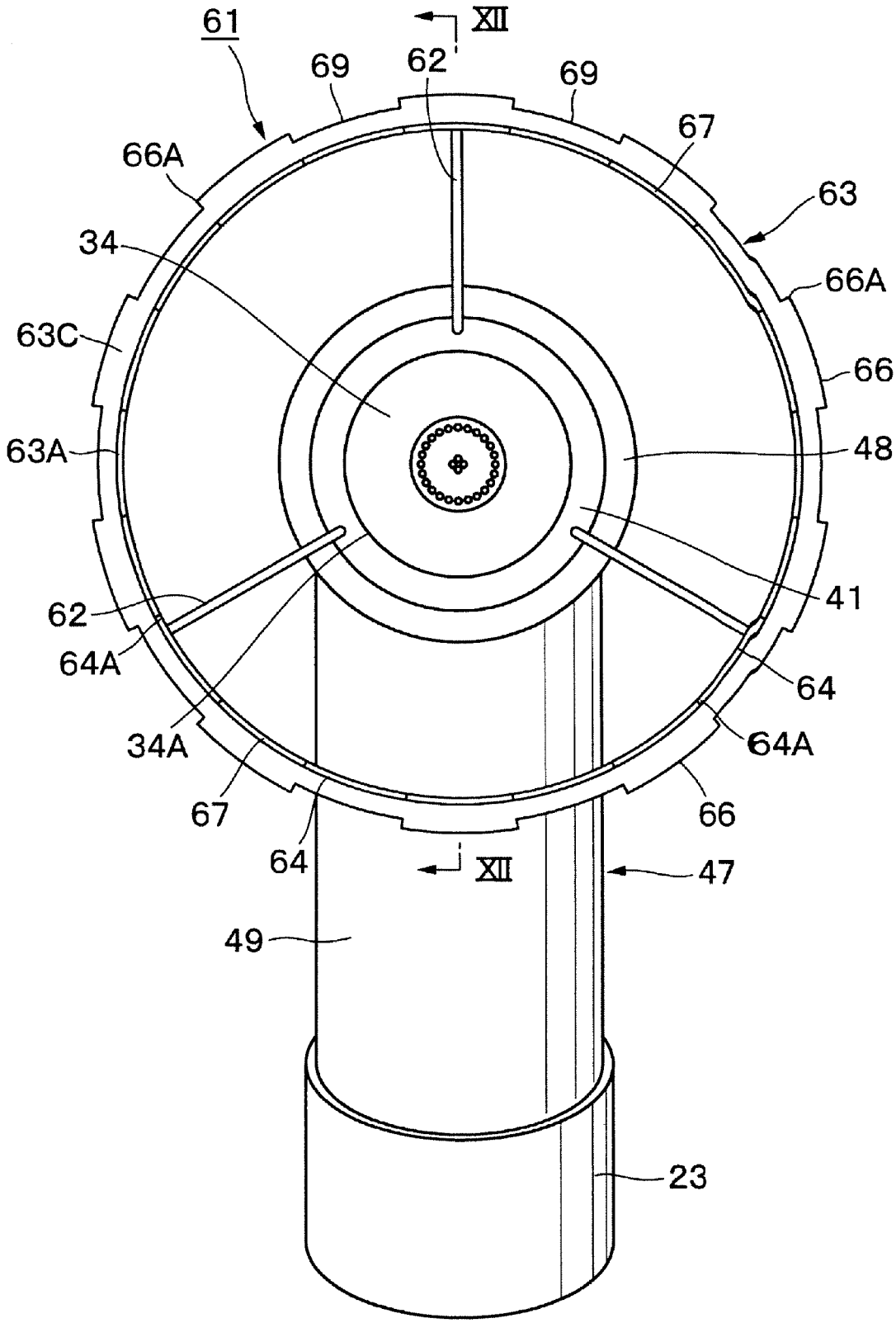
FIG. 11 is a left-hand side view similar to FIG. 8, showing a rotary atomizing head type coating apparatus according to a third embodiment of the invention.
Figure 12:
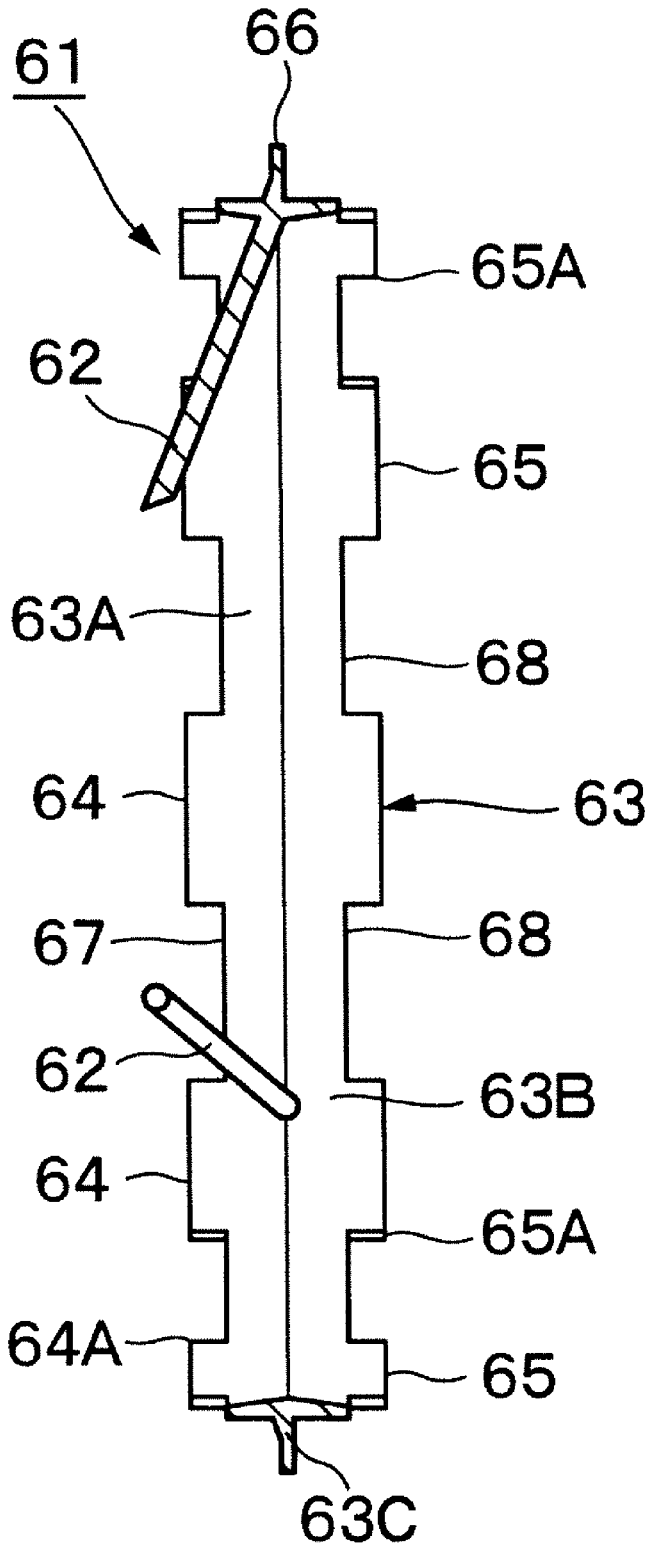
FIG. 12 is a cross-sectional view of a high voltage discharge electrode assembly alone, taken in the direction of arrows XII-XII of FIG. 11.
Figure 13:
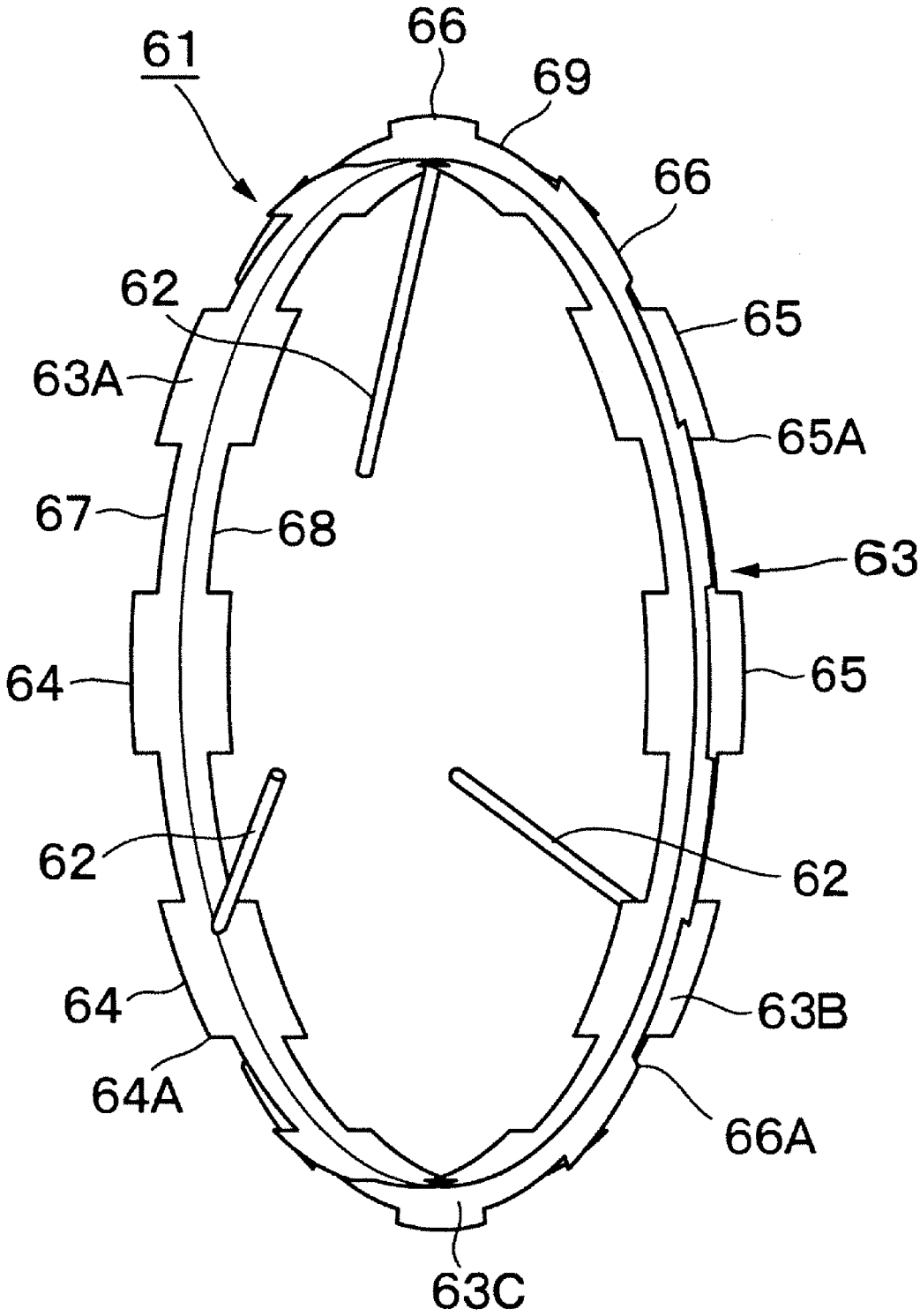
FIG. 13 is a perspective view of the high voltage discharge electrode assembly of FIG. 11 alone.
Figure 14:
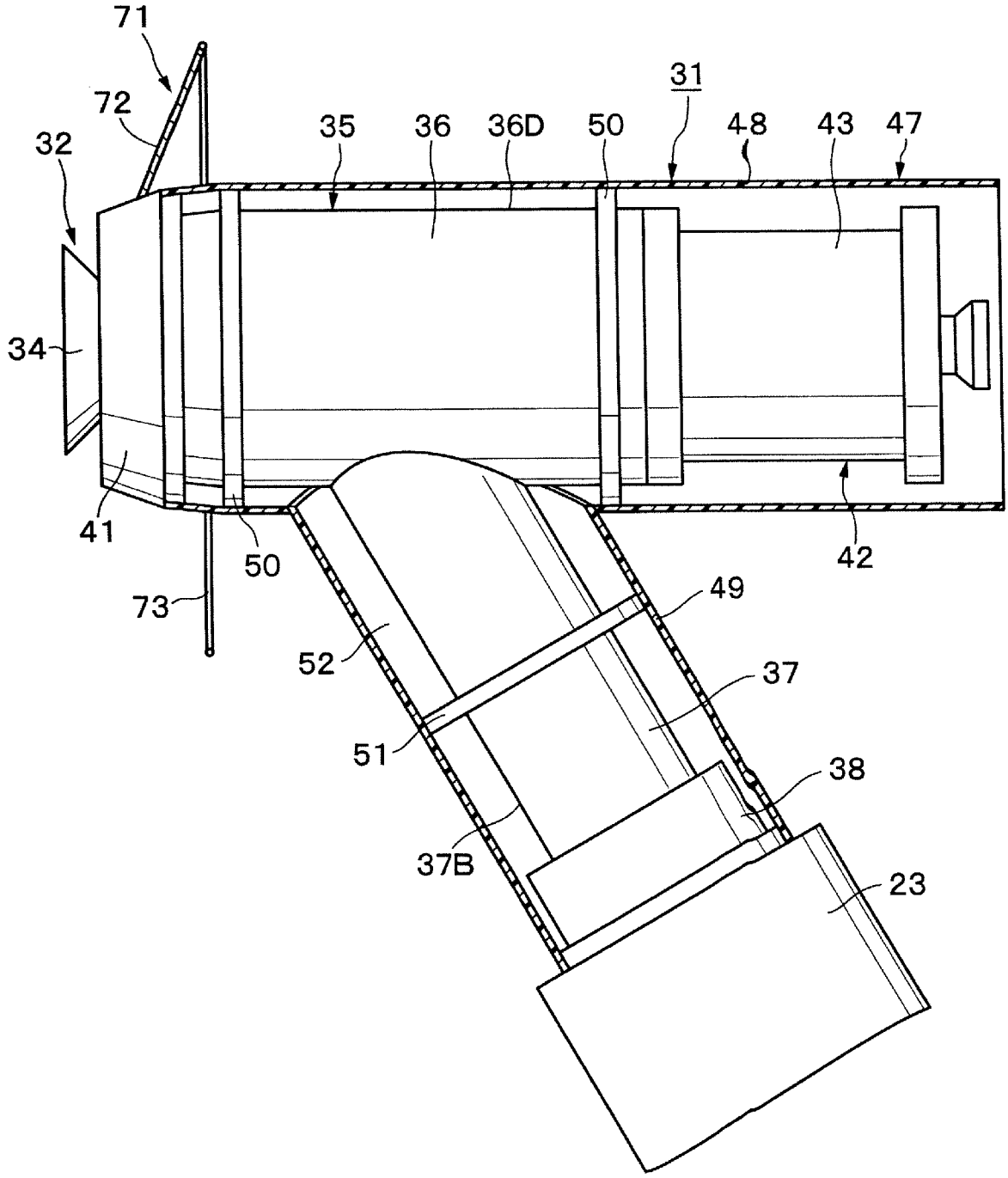
FIG. 14 is a front view similar to FIG. 6, showing a rotary atomizing head type coating apparatus according to a fourth embodiment of the invention, with a cover member cut away to show inner components.
Figure 15:
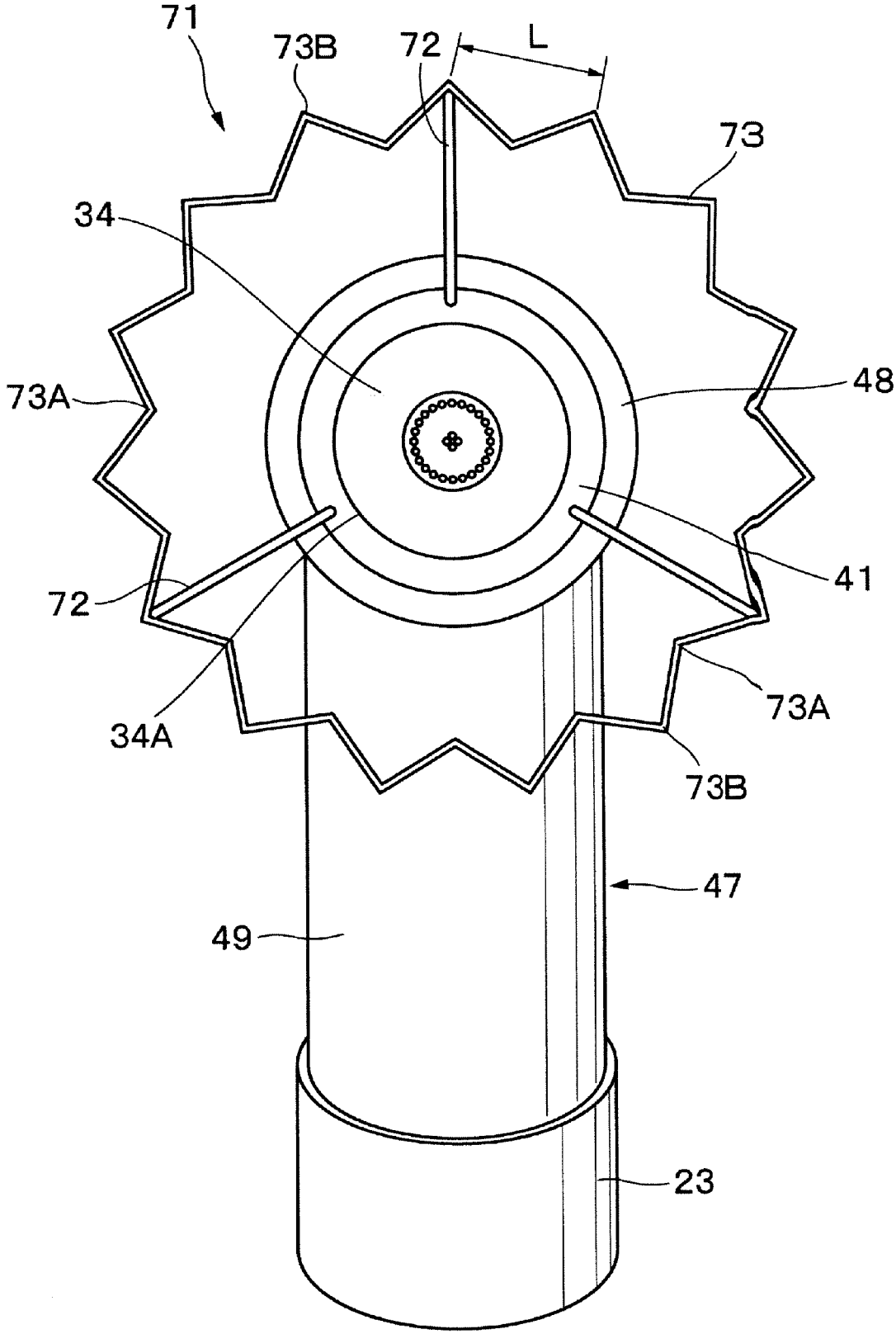
FIG. 15 is a left-hand side view similar to FIG. 8, showing a rotary atomizing head type coating apparatus according to a fourth embodiment of the invention.
Figure 16:
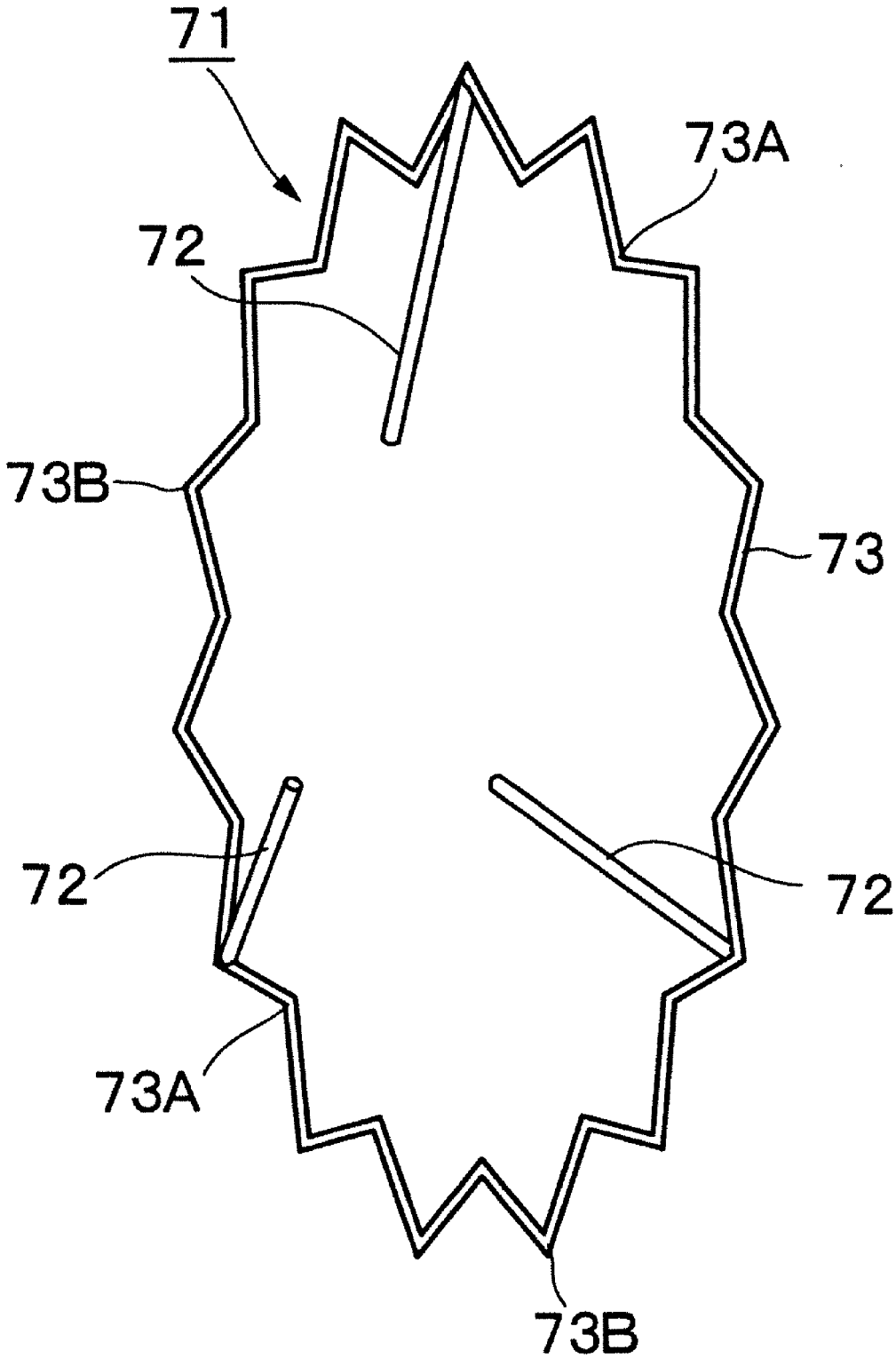
FIG. 16 is a perspective view of a high voltage discharge electrode assembly of FIG. 15 alone.

Now, turning to FIGS. 11 to 13, there is shown a rotary atomizing head type coating apparatus according to a third embodiment of the present invention. This third embodiment has a feature in that a number of notches are provided at intervals around the edge portion of the entire blade ring. In the following description of the third embodiments, those component parts which are identical with counterparts in the foregoing first embodiments are simply designated by the same reference numerals or characters to avoid repetitions of similar explanations.

Indicated at 61 is a high voltage discharge electrode assembly which is provided around the outer periphery of a shaping air ring 41. This high voltage discharge electrode assembly 61 is composed of support arms 62, blade ring 63, edge portions 64 to 66 and notches 67 to 69, which will be described hereinafter.

Indicated at 62 are a number of support arms which are extended radially outward of a shaping air ring 41. These support arms 62 are extended radially outward from the outer periphery of the housing member 35 to a point outward of the outer periphery of a body cover 48. In this case, for example, three support arms 62 are provided at uniform angular intervals around the shaping air ring 41 to support a blade ring 63 thereon.

Indicated at 63 is a blade ring which are supported on outer distal ends of the radial support arms 62. Substantially in the same way as the blade ring 55 in the foregoing second embodiment, this blade ring 63 is formed in the shape of a circular ring by the use of a conducting material like a metal, for example. Further, the blade ring 63 is provided with fore and rear blade portions 63A and 63B which are projected in forward and rearward directions, respectively, and a ring-like outer flange portion 63C which is projected radially outward on the circumference of the blade ring 63. Further, the blade ring 63 is so located as to circumvent a front side portion of the body cover 48, and connected to a high voltage generator 45 through the support arms 54 and shaping air ring 41. Accordingly, a high voltage is applied to the blade ring 63 from the high voltage generator 45.

Indicated at 64, 65 and 66 are edge portions which are provided on the fore and rear blade portions 63A and 63B and the outer flange portion 63C of the blade ring 63.

In this instance, a front edge portion 64 is formed by gradually reducing the thickness of the fore blade portion 63A in the forward direction in the fashion of a sharp thin blade. Moreover, the front edge portion 64 is divided into a number of front edge sections (ten front edge sections in the case of the third embodiment shown) by adjacent notches 67.

A rear edge portion 65 is formed by gradually reducing the thickness of the rear blade portion 63B in the fashion of a sharp thin blade, and divided into ten rear edge sections. Further, an outer edge portion 66 is formed by gradually reducing the thickness of the outer flange portion 63C in a radially outward direction in the fashion of a sharp thin blade, and divided into ten outer edge sections.

The front, rear and outer edge portions 64 to 66 function to intensify electric field around the circular body of the blade ring 63. For example, when a high voltage of 90 kV is applied, a discharge current of approximately 20 μA to 100 μA flows through each one of the edge portions 64 to 66 to induce stabilized corona discharge.

Indicated at 67 to 69 are a plural number of notches which are formed in the edge portions 64 to 66 at intervals in the circumferential direction of the blade ring 63. In the case of the particular embodiment shown, the notches 67 to 69, for example, ten notches are formed in the edge portions 64 to 66 at uniform intervals in the circumferential direction of the blade ring 63.

In this instance, each one of the notches 67 is formed in an arcuate shape and extended in a circumferential direction along the front edge portions 64. Further, a plural number of notches 67 (ten notches in the case of the third embodiment shown) are formed at uniform intervals in the circumferential direction between adjacent front edge portions 64. By the provision of the notches 67, an electric field is further concentrated at the opposite ends 64A of the front edge portions 64 to accelerate discharge.

Similarly, ten notches 68 are formed at uniform intervals in the circumferential direction between front edge portions 65 to further concentrate an electric field at the opposite ends of the edge sections 65A. Moreover, ten notches 69 are formed at uniform intervals in the circumferential direction between outer edge portions 66 to further concentrate an electric field at the opposite ends 66A of the latter.

In a case where the respective notches are small in length L in the circumferential direction, ion clouds resulting from discharging can act as a pseudo-electrode, conversely suppressing the discharge by easing the intensity of an electric field. Therefore, in the present embodiment, the notches 67 to 69 are formed to have a sufficiently large length as compared to the intervals of corona clouds, for example, a length L greater than 20 mm.

Thus, the third embodiment can produce the same operational effects as the foregoing second embodiment. Especially in the case of the third embodiment, notches 67 to 69 are formed in the edge portions 64 to 66, respectively, to further concentrate an electric field at the opposite ends of the respective edge sections, which are at the opposite sides of the notches 67 to 69 in the circumferential direction. Thus, the notches make discharges take place more easily at the edges 64A to 66A, encouraging corona discharges at the edge portions 64 to 66.

Now, turning to FIGS. 14 to 17, there is shown a rotary atomizing head type coating apparatus according to a fourth embodiment of the present invention. This fourth embodiment has a feature in the provision of a star ring which is bent at a plural number of points alternately toward and away from a housing member. In the following description of the fourth embodiment, those component parts which are identical with counterparts in the foregoing second embodiment are simply designated by the same reference numerals or characters to avoid repetitions of similar explanations.

Indicated at 71 is a high voltage discharge electrode assembly which is located around the outer periphery of a shaping air ring 41. This high voltage discharge electrode assembly 71 is composed of support arms 72 and a star ring 73, which will be described hereinafter.

Denoted at 72 are support arms which are provided around the outer periphery of the shaping air ring 41. These support arms 72 are extended radially outward from the side of the housing member 35 to a point outward of the outer periphery of the body cover 48. In the particular embodiment shown, for example, three support arms 72 are located in equidistant angular positions around the outer periphery of the shaping air ring 41 to support a star ring 73.

Indicated at 73 is a star ring which is formed in the shape of a star and provided on the front edge of the support arm 72, for example, by the use of a conducting wire like a metal wire. In this regard, it is preferable to form the star ring 73, for example, by the use of a spring steel wire so that it is deformable when it comes into contact with a worker or other object but it can restore its shape by itself afterwards. Further, the diameter of the wire to be used for the star ring 73 should be of a gauge suitable for securing a discharge initiating electric field in addition to shape retainability, for example, should be preferably in the range of from 0.3 mm to 5 mm.

The star ring 73 is formed by bending a wire at a plural number of points alternately in inward and outward directions toward and away from the cover member 47 and in the shape of a ring. Thus, the star ring 73 contains alternately a inward bend portion 73A which is located closer to the cover member 47, and an outward bend portions 73B which is located away from the cover member 47. Moreover, for example, fifteen bend portions 73A, 73B are each provided alternately at uniform intervals in the circumferential direction.

In this instance, the inward bend portions 73A in adjacent positions spaced away from each other by a distance L which is substantially larger than an interval between corona clouds, for example, by a distance L larger than 20 mm. Similarly, the outward bend portions 73B in adjacent positions are spaced away from each other by a distance L larger than 20 mm. Thus, the inward and outward bend portions 73A and 73B serve to concentrate an electric field furthermore.

In this connection, the wire diameter of the star ring 73 and discharge initiating electric field are in the relations as discussed below.

Figure 17:
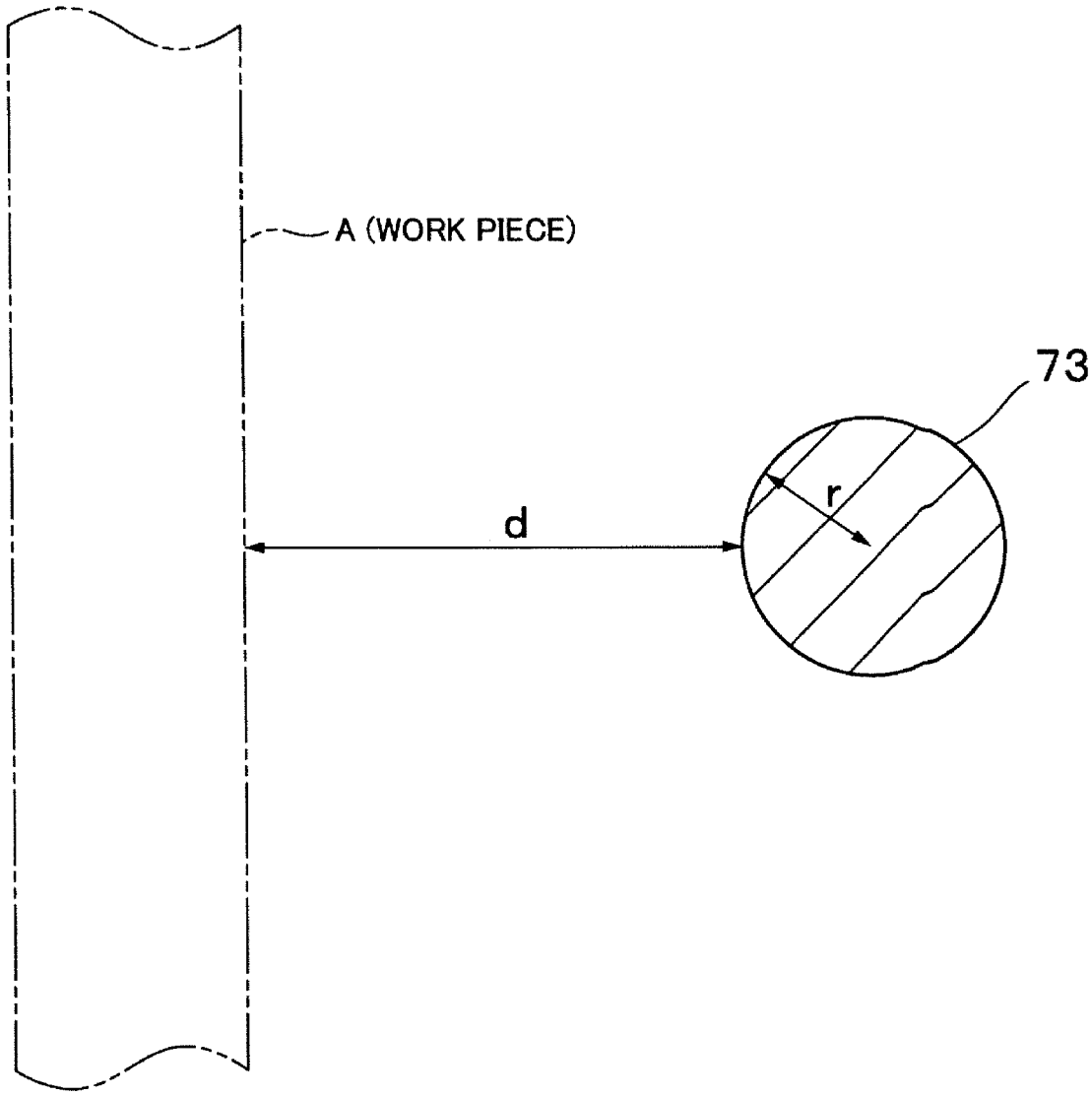
FIG. 17 is a schematic illustration explanatory of positional relations between a star ring and a work piece.

In the first place, as shown in FIG. 17, assuming that a wire is a cylinder of an infinite length, a cylinder of a radius r is located in a position which is spaced from a flat plate (a work piece A) at the earth potential by a spatial insulating distanced. At this time, an electric field E which is formed around the cylinder (wire) is expressed as ($E=\eta\times E0$), that is, as a value which is obtained by multiplying an electric field concentration coefficient $\eta$ of Equation (1) below by a mean electric field E0.

$$\eta = \frac{\sqrt{\left\{\frac{d}{r}\times\left(\frac{d}{r}+2\right)\right\}}}{\log\left[\frac{d}{r}+1+\sqrt{\left\{\frac{d}{r}\times\left(\frac{d}{r}+2\right)\right\}}\right]} \tag{1}$$

In this instance, if a voltage of 60 kV is applied to the star ring 73 and the distance d between the star ring 73 and a work piece A is 300 mm, the mean electric field E0 between the star ring 73 and the work piece A is 0.2 kV/mm. On the other hand, a discharge initiating electric field, which starts a corona discharge in standard atmospheric air, is approximately 3 kV/mm. Therefore, in order to induce stable and continuous corona discharge in an assured way despite variations in the distance d to the work piece A and in the applied voltage to the star ring 73, the electric field to be formed around the star ring 73 is preferred to be at least three times higher than the discharge initiating electric field, that is, to be as strong as 9 kV/mm or more.

Thus, in order to maintain around the star ring 73 an electric field which is at least three times as strong as the discharge initiating electric field, the electric field concentration coefficient $\eta$ should be set at 45 or at a greater value. In this regard, since the wire radius r in Equation (1) above needs to be set at 1.05 mm or at a smaller value, the wire diameter should be 2.1 mm or smaller.

The smaller the wire diameter of the star ring 73, the higher the intensity of electric field but lower in mechanical strength. Further, even if the wire diameter is increased, an electric field of a strength three times as high as a discharge initiating electric field can be formed around the star ring 73 by increasing the value of the high voltage to be applied to the star ring 73. Gathering from these observations, the wire diameter of the star ring 73 is set in the range of approximately 0.3 mm to 5 mm in the present embodiment.

Thus, the fourth embodiment can produce substantially the same operational effects as the foregoing second embodiment. Especially in the case of the fourth embodiment, the star ring 73 which is alternately bent in inward and outward directions toward and away from the cover member 47 is provided to concentrate an electric field at the bent portions 73A and 73B. That is, discharges take place more easily at the bent portions 73A and 73B of the star ring 73, accelerating corona discharges from the bent portions 73A and 74B.

Further, since the wire diameter of the star ring 73 is in the range of from 0.3 mm to 5 mm, the electric field for the star ring 73 as a whole can be intensified to a level higher than a discharge initiating electric field, making the entire star ring 73 a high electric field. Therefore, corona discharge can be induced on the entire star ring 73 to supply a sufficient amount of discharge ions to the cover member 47 while at the same time recharging paint particles.

Figure 18:
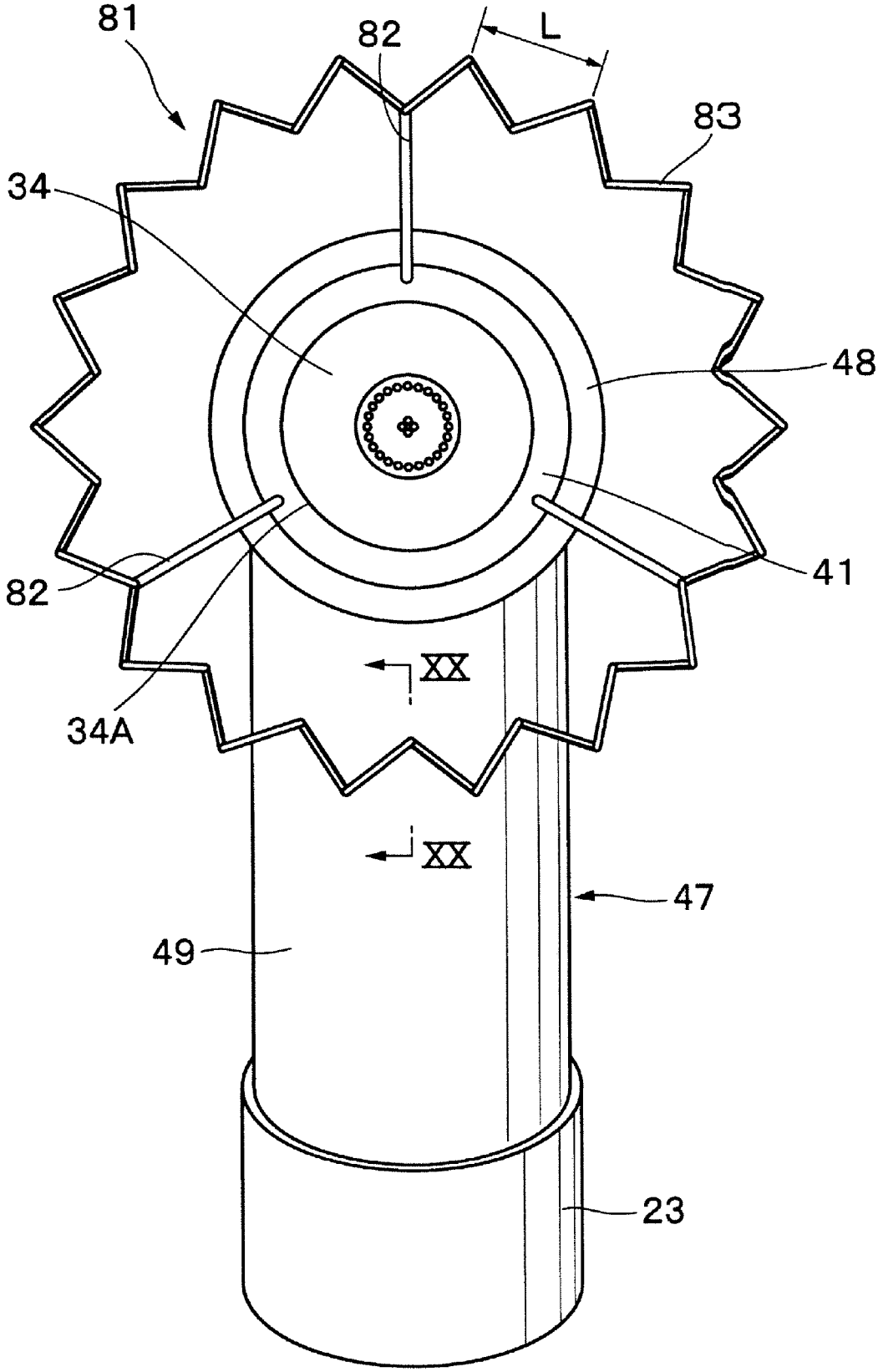
FIG. 18 is a left-hand side view similar to FIG. 8, showing a rotary atomizing head type coating apparatus according to a fifth embodiment of the invention.
Figure 19:
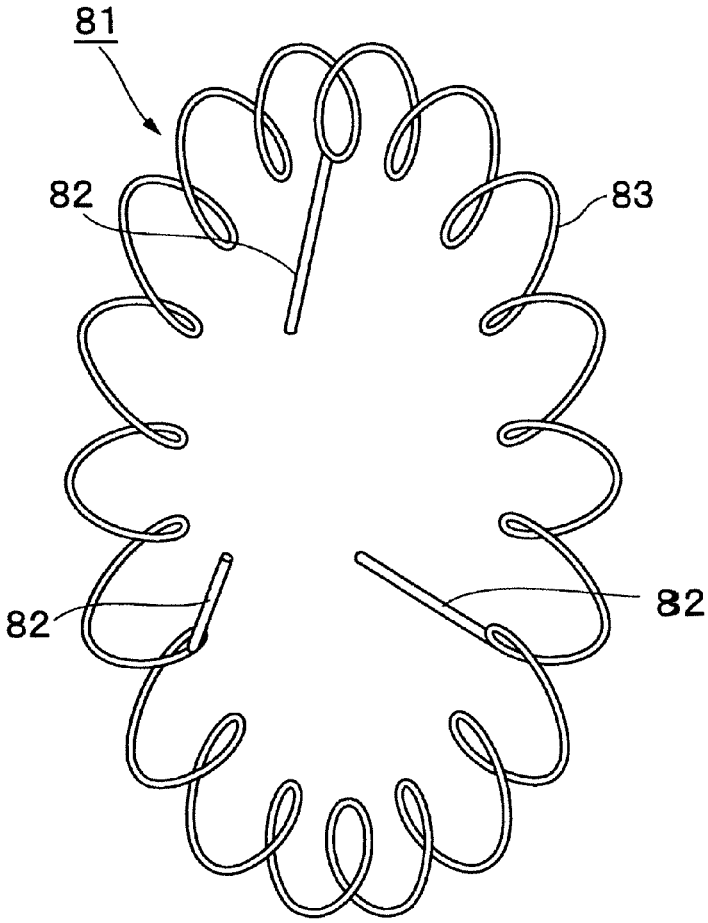
FIG. 19 is a perspective view of a high voltage discharge electrode assembly of FIG. 18 alone.
Figure 20:
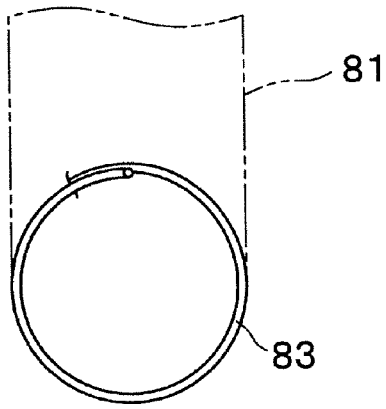
FIG. 20 is an enlarged cross-sectional view of a helical ring, taken in the direction of arrows XX-XX of FIG. 18.

Turning now to FIGS. 18 to 20, there is shown a rotary atomizing head type coating apparatus according to a fifth embodiment of the present invention. This fifth embodiment has a feature in the provision of a helical ring which is helically wound in such a way as to circumvent a housing member in circumferential direction. In the following description of the fifth embodiments, those component parts, which are identical with counterparts in the foregoing second embodiments, are simply designated by the same reference numerals or characters to avoid repetitions of similar explanations.

Indicated at 81 is a high voltage discharge electrode assembly which is located around the outer periphery of the shaping air ring 41. This high voltage discharge electrode assembly 81 is composed of support arms 82, helical ring 83 and so on, which will be described hereinafter.

Indicated at 82 are support arms which are extended radially outward from the outer periphery of the shaping air ring 41. More specifically, the support arms 82 are extended radially outward from the side of the housing member 35 as far as a position on the outer peripheral side (radially outward) of the body cover 48. For example, three support arms 82 are provided at uniform angular intervals around the shaping air ring 41 to support the helical ring 83 thereon.

Indicated at 83 is a helical ring 83 which are supported on outer distal ends of the support arms 82. This helical ring 83 is formed substantially in a ring shape, for example, by use of conducting material like a metal wound 18 times in helical shape (coil shape) while using a said wire. Further, the diameter of the wire to be used for the helical ring 83 should be of a gauge suitable for securing a discharge initiating electric field in addition to shape retainability, for example, should be preferably in the range of from 0.3 mm to 5 mm, similar to the star ring 73 in the forth embodiment. Moreover, the length of each turn pitch (distance L) of the helical ring 83 is spaced away from each other and it is substantially larger than a interval between corona clouds, for example, by a distance L larger than 20 mm.

Thus, the fifth embodiment can produce the same operational effects as the foregoing second and forth embodiments. Especially in the case of the fifth embodiment, helical ring 83 is constructed by wire wound in circumferential direction to circumvent body cover 48. The use of a helical ring 83 permit to provide a high voltage discharge electrode assembly 81 in a more compact form in outer configuration, and to increase the wire length of the helical ring 83. Since corona discharges can be induced on the entire wire which is elongated in length, it becomes possible to downsize a high voltage discharge electrode assembly 81 in a compact form and increase the amount of discharge ions.

A conducting shaping air ring 41 is employed in the second to fifth embodiment described above. However, if desired, it is possible to attach an insulating shaping air ring in place of the conducting shaping air ring as in the first embodiment.

Further, in the second to fifth embodiment, a high voltage discharge electrode assembly 53, 61, 71 or 81 is applied to a rotary atomizing head type coating apparatus with a housing member 35 which is composed of a main body portion 36 and a neck portion 37. However, the present invention is not limited to this feature, and the high voltage discharge electrode assemblies 53, 61, 71 and 81 of the second to fifth embodiments may be applied to a rotary atomizing head type coating apparatus with a housing member without a neck portion like the housing member 9 in the first embodiment. If desired, the high voltage discharge electrode assembly 15 of the first embodiment may be applied to a rotary atomizing head type coating apparatus as in the second embodiment.

Furthermore, in the second and third embodiment, an outer flange portion 55C, 63C is provided on the outer periphery of a blade ring 55, 63 of high voltage discharge electrode assembly 53, 61. However, the outer flange portion 55C or 63C may be omitted if desired. In the second and third embodiment, one of or both of front and rear blade portions 55A and 55B or 63A and 63B of the blade ring 55 or 63 may be omitted if desired.

Moreover, in each one of the foregoing embodiments, the cover member 10, 47 may be is provided around the housing member 9, 35, yet may be omitted if necessary. In such a case, an electrostatic charge is imparted to exterior surfaces of the housing member 9, 35 instead of the cover member 10, 47 by corona discharge from high voltage discharge electrode assembly 15, 53, 61, 71, 81.

Further, in each one of the foregoing embodiments, the present invention is applied to a rotary atomizing head type coating apparatus (a rotary atomizing head type electrostatic coating apparatus) which is equipped with a rotary atomizing head 3, 34 for atomizing and spraying paint. However, the present invention is not limited to an electrostatic coating apparatus of this sort, and can be similarly applied to other electrostatic coating apparatus such as pneumatic atomization type electrostatic coating apparatus and hydraulic atomization type electrostatic coating apparatuses as well.

The invention claimed is:

1. An electrostatic coating apparatus comprised of a paint atomizing means adapted to spray atomized paint particles toward a work piece, a housing member formed of an electrically insulating material to accommodate said paint atomizing means in position, a high voltage application means for imparting a high voltage electrostatic charge to paint particles sprayed by said paint atomizing means for electrostatic deposition on said work piece, and a corona ring formed in the shape of a ring circumventing said housing member and applied with a high voltage from said high voltage application means to induce corona discharges, characterized in that said electrostatic coating apparatus comprises:

said corona ring formed of a conducting material and having a blade ring projected at least in axially forward, axially rearward, radially inward or radially outward of said housing member, said blade ring being gradually reduced in thickness toward a projected end in the fashion of a thin blade, providing a sharp edge portion all around said blade ring, said projected end of the blade ring projecting in a rearward direction; and said blade ring formed of a conducting material and discharging a high voltage continuously substantially on and around entire edge portion.

2. An electrostatic coating apparatus as defined in claim 1, wherein a number of notches are provided at intervals along said edge portion of said blade ring.

3. An electrostatic coating apparatus comprised of a paint atomizing means adapted to spray atomized paint particles toward a work piece, a housing member formed of an electrically insulating material to accommodate said paint atomizing means in position, a high voltage application means for imparting a high voltage electrostatic charge to paint particles sprayed by said paint atomizing means for electrostatic deposition on said work piece, and a corona ring formed in the shape of a ring circumventing said housing member and applied with a high voltage from said high voltage application means to induce corona discharges, wherein said electrostatic coating apparatus comprises:

said corona ring constituted by a star ring formed in the shape of a star by bending a wire alternately in radially inward and outward directions toward and away from said housing member; and said star ring discharging a high voltage continuously substantially on and around entire parts thereof.

4. An electrostatic coating apparatus comprised of a paint atomizing means adapted to spray atomized paint particles toward a work piece, a housing member formed of an electrically insulating material to accommodate said paint atomizing means in front edge portion, a high voltage application means for imparting a high voltage electrostatic charge to paint particles sprayed by said paint atomizing means for electrostatic deposition on said work piece, and a corona ring formed in the shape of a ring circumventing said housing member and applied with a high voltage from said high voltage application means to induce corona discharges, wherein said electrostatic coating apparatus comprises:

said corona ring constituted by a helical ring formed by helically winding a wire into the shape of a circular endless coil; and said helical ring discharging a high voltage continuously substantially on and around entire parts thereof.

5. An electrostatic coating apparatus as defined in claim 3, wherein said wire has a diameter between 0.3 mm and 5 mm.

6. An electrostatic coating apparatus as defined in claim 4, wherein said wire has a diameter between 0.3 mm and 5 mm.

7. An electrostatic coating apparatus as defined in claim 1, further comprising an air ring attached to a cover of the housing; and a plurality of support arms extending between the air ring and the blade ring, wherein the plurality of support arms are made of a conducting material.

8. An electrostatic coating apparatus as defined in claim 1, wherein an end of the blade ring opposite to the projected end is rounded in an arcuate shape.

9. An electrostatic coating apparatus as defined in claim 1, wherein the blade ring formed of a conducting material is exposed to an exterior of the apparatus.

10. An electrostatic coating apparatus as defined in claim 1, wherein the blade ring forms an electrostatic field of approximately 3 kV/m to 5 kV/m.

* * * * *